US011491625B2

(12) United States Patent
Shige et al.

(10) Patent No.: US 11,491,625 B2
(45) Date of Patent: Nov. 8, 2022

(54) DRIVING MACHINE

(71) Applicant: KOKI HOLDINGS CO., LTD., Tokyo (JP)

(72) Inventors: Tetsuhito Shige, Ibaraki (JP); Daiki Kiyohara, Ibaraki (JP); Yoshiichi Komazaki, Ibaraki (JP); Masashi Nishida, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 276 days.

(21) Appl. No.: 16/756,098

(22) PCT Filed: Sep. 28, 2018

(86) PCT No.: PCT/JP2018/036307

§ 371 (c)(1),
(2) Date: Apr. 14, 2020

(87) PCT Pub. No.: WO2019/087637

PCT Pub. Date: May 9, 2019

(65) Prior Publication Data

US 2020/0282535 A1 Sep. 10, 2020

(30) Foreign Application Priority Data

Oct. 31, 2017 (JP) ..... JP2017-210793

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06
See application file for complete search history.

(56) References Cited

U.S. PATENT DOCUMENTS 2,575,455 A * 11/1951 Lang ..... B25C 1/06 227/138
3,243,093 A * 3/1966 Schaefer, Jr. ..... B25C 1/06 227/132

(Continued)

FOREIGN PATENT DOCUMENTS

EP 3 028 817 A1 6/2016
JP 2008-260124 A 10/2008

(Continued)

OTHER PUBLICATIONS

International Search Report issued in corresponding International Patent Application No. PCT/JP2018/036307, dated Nov. 20, 2018, with English translation.

(Continued)

*Primary Examiner* — Nathaniel C Chukwurah
*Assistant Examiner* — Lucas E. A. Palmer
(74) *Attorney, Agent, or Firm* — McDermott Will & Emery LLP

(57) ABSTRACT

Provided is a driving machine capable of stabilizing a relationship between timing when a first movable member starts operating in a first directing and timing when a second movable member starts operating in a second direction. The driving machine including a first movable member 12 operable in a first direction D1 and a second direction D2, and a second movable member 18 operable in the first direction D1 and the second direction D2 has a first regulating mechanism, a second regulating mechanism, and a third regulating mechanism 71, and the third regulating mechanism is held in a first state when the first movable member 12 is prevented from operating in the first direction D1, and the third regulating mechanism 71 switches from the first state to the second state when the first movable member 12 is allowed to operate in the first direction D1 and operates.

11 Claims, 24 Drawing Sheets

(56) References Cited

U.S. PATENT DOCUMENTS 3,589,588 A * 6/1971 Vasku ..... B25C 1/06 227/132
5,004,140 A * 4/1991 Fushiya ..... B25C 1/06 227/8
5,720,423 A * 2/1998 Kondo ..... B25C 1/06 227/132
5,802,691 A * 9/1998 Zoltaszek ..... F16H 25/20 227/129
6,705,503 B1 * 3/2004 Pedicini ..... B25C 1/06 173/205
9,592,596 B2 * 3/2017 Schiestl ..... B25C 1/00
2003/0192933 A1 * 10/2003 Pedicini ..... B25C 1/06 227/131
2004/0232194 A1 * 11/2004 Pedicini ..... B25C 1/06 227/131
2005/0167465 A1 * 8/2005 Llewellyn ..... B25C 5/15 173/117
2006/0261127 A1 * 11/2006 Wolf ..... B25C 1/06 227/131
2007/0023472 A1 * 2/2007 Schiestl ..... B25C 1/06 227/129
2007/0108250 A1 * 5/2007 Odoni ..... B25C 5/1624 227/107
2007/0284406 A1 * 12/2007 Okouchi ..... B25C 1/06 227/132
2008/0006672 A1 * 1/2008 Tanimoto ..... B25C 1/06 227/132
2008/0190988 A1 * 8/2008 Pedicini ..... B25C 1/04 137/540
2008/0257934 A1 * 10/2008 Tanimoto ..... B25C 1/06 227/146
2008/0296339 A1 * 12/2008 Fielitz ..... B25C 5/15 227/107
2009/0078734 A1 * 3/2009 Chang ..... B25C 1/06 227/107
2009/0236387 A1 * 9/2009 Simonelli ..... B25F 5/006 227/8
2010/0065294 A1 * 3/2010 Hirabayashi ..... B25C 1/06 173/122
2010/0089963 A1 * 4/2010 Franz ..... B25C 5/15 227/8
2010/0102104 A1 * 4/2010 Tanimoto ..... B25C 1/06 173/178
2011/0000949 A1 * 1/2011 Ito ..... B25C 1/06 227/138
2012/0211540 A1 * 8/2012 Kondou ..... B25C 1/008 227/140
2013/0334277 A1 * 12/2013 Shima ..... B25C 1/06 318/114
2015/0258671 A1 9/2015 Kondou et al.
2015/0375381 A1 * 12/2015 Tanji ..... B25C 1/06 227/146
2016/0176032 A1 * 6/2016 Tanji ..... B25C 1/06 227/146
2016/0288305 A1 * 10/2016 McCardle ..... B25C 1/047
2016/0325419 A1 * 11/2016 Sperrfechter ..... B25C 1/08
2017/0036332 A1 2/2017 Kondou et al.
2017/0274513 A1 * 9/2017 Pedicini ..... B25C 1/003
2017/0297187 A1 * 10/2017 Nishikawa ..... B25C 7/00
2017/0361444 A1 * 12/2017 Namouz ..... B25C 1/06
2019/0099871 A1 * 4/2019 Fukushima ..... B25C 1/046
2019/0299379 A1 10/2019 Kondou et al.
2020/0130156 A1 * 4/2020 Takeuchi ..... B25C 1/008
2020/0189080 A1 * 6/2020 Aizawa ..... B25C 1/047
2020/0223046 A1 * 7/2020 Hoshino ..... B25C 1/06
2020/0282535 A1 * 9/2020 Shige ..... B25C 5/15

FOREIGN PATENT DOCUMENTS

JP 2012-183632 A 9/2012
WO 2015015967 A1 2/2015
WO 2016/031716 A1 3/2016

OTHER PUBLICATIONS

Extended European Search Report issued in corresponding European Patent Application No. 18872102.1-1017, dated Sep. 25, 2020.

* cited by examiner

12 : FIRST MOVABLE MEMBER
18 : SECOND MOVABLE MEMBER
36 : ENERGIZING MECHANISM
71 : THIRD REGULATING MECHANISM
D1 : FIRST DIRECTION
D2 : SECOND DIRECTION

DRIVING MACHINE

CROSS REFERENCE TO RELATED APPLICATIONS

This application is the U.S. National Phase under 35 U.S.C. § 371 of International Patent Application No. PCT/JP2018/036307, filed on Sep. 28, 2018, which claims the benefits of Japanese Patent Application No. 2017-210793, filed on Oct. 31, 2017 the entire contents of which are hereby incorporated by reference.

TECHNICAL FIELD

The present invention relates to a driving machine having a first movable member operable in a first direction and a second direction.

BACKGROUND ART

A driving machine including a first movable member operable in a first direction and a second direction is disclosed in Patent Document 1. The driving machine disclosed in Patent Document 1 includes a housing, a motor, a plunger, a weight, a coil spring, a drive mechanism, and a nose part. The plunger is operable downward as a first direction and upward as a second direction. A rod is attached to the plunger. The plunger and rod constitute a first movable member. The weight is operable upward and downward.

The motor and the drive mechanism are provided in the housing. The drive mechanism has a drive gear, a first pulley, and a second pulley. The drive gear is coupled to the motor. The first pulley meshes with the drive gear and the second pulley. The first pulley has a plurality of roller cams, and the second pulley has a plurality of roller cams. The housing has a handle part, and a battery is detachably attached to the handle part. A trigger is provided on the handle part.

When the motor is stopped, the plunger stops at a bottom dead center and the weight stops at a top dead center. When an operator pulls the trigger, the battery supplies power to the motor and the motor rotates. A rotative force (torque) of the motor is transmitted to the first pulley via the drive gear. A rotative force of the first pulley is transmitted to the second pulley. When the roller cam of the first pulley is engaged with the plunger, the plunger operates from the bottom dead center toward the top dead center. When the roller cam of the second pulley is engaged with the weight, the weight operates from the top dead center toward the bottom dead center. The coil spring is compressed by operations of the plunger and the weight, and the coil spring stores (accumulates) elastic energy.

When the roller cam of the first pulley is released from the plunger, the plunger starts operating downward due to elastic energy of the coil spring. When the roller cam of the second pulley is released from the weight, the weight starts operating upward due to the elastic energy of the coil spring. As the plunger operates (moves) downward, the rod strikes a nail lying at the nose part and the nail is driven into a workpiece (struck object). After the rod hits (strikes) the nail, the plunger reaches the bottom dead center. Also, the weight reaches the top dead center.

RELATED ART DOCUMENTS

Patent Documents

Patent Document 1: International Publication WO 2016/031716

SUMMARY OF THE INVENTION

Problems to be Solved by the Invention

The inventors of the present application have known the following problem: a relationship between timing when the first movable member starts operating in the first direction and timing when the second movable member starts operating in the second direction does not match due to manufacturing errors of elements constituting the drive mechanism of the driving machine or to a gap(s) formed between the elements, thereby bringing the possibility that some driving feeling will vary (change).

An object of the present invention is to provide a driving machine that can realize improvement of the driving feeling by stabilizing the relationship between the timing when the first movable member starts operating in the first direction and the timing when the second movable member starts operating in the second direction.

Means for Solving the Problems

A driving machine according to an embodiment, which has a first movable member operable in a first direction and a second direction opposite to the first direction and a second movable member operable in the first direction and the second direction, includes: an energizing mechanism that energizes the first movable member in the first direction and energizes the second movable member in the second direction; a first regulating mechanism that makes an operation of the first movable member preventable and allowable in the first direction; a second regulating mechanism that makes an operation of the second movable member preventable and allowable in the second direction; and a third regulating mechanism that, when the second regulating mechanism allows the operation of the second movable member, has a first state of preventing the second movable member from operating in the second direction and a second state of allowing the second movable member to operate in the second direction, in which the third regulating mechanism is held in the first state while the first movable member is prevented from operating in the first direction, and the third regulating mechanism switches from the first state to the second state when the first movable member is allowed to operate in the first direction and operates.

Effects of the Invention

In the driving machine according to one embodiment, the relationship between the timing when the first movable member starts operating in the first direction and the timing when the second movable member starts operating in the second direction can be easily stabilized, and the driving feeling can be improved.

DETAILED DESCRIPTION OF PREFERRED EMBODIMENTS

Figure 1:
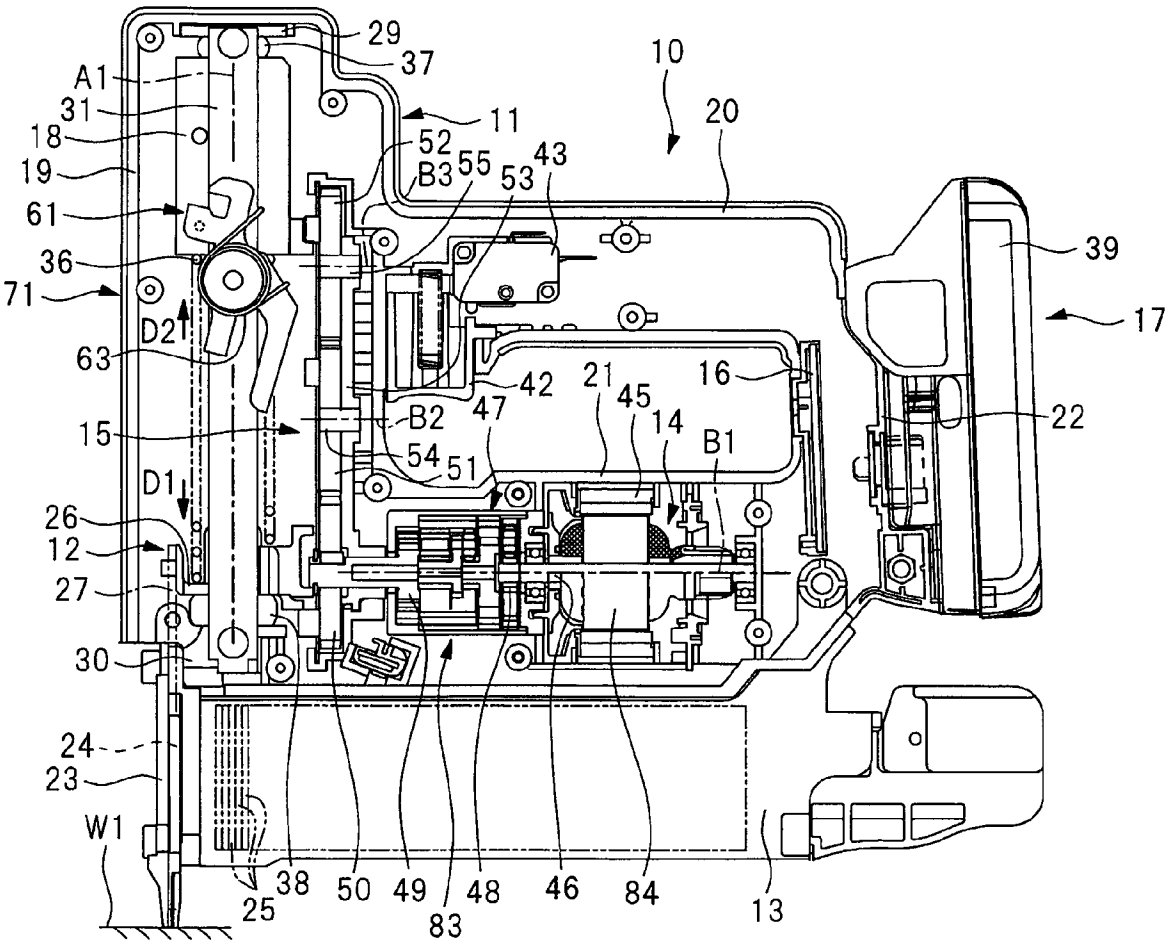
FIG. 1 is a side cross-sectional view showing a driving machine corresponding to some embodiments included in the present invention.

A typical embodiment of a driving machine included in the present invention has: a first movable member operable in a first direction and a second direction; a second movable member operable in the first direction and the second direction; an energizing mechanism for energizing the first movable member in the first direction and energizing the second movable member in the second direction; and a first regulating mechanism for preventing and allowing the first movable member from operating and to operate in the first direction; a second regulating mechanism for preventing and allowing the second movable member from operating and to operate in the second direction; and a third regulating mechanism that is provided with a first state of preventing the second movable member from operating in the second direction and a second state of allowing the second movable member to operate in the second direction. Then, when the first movable member operates in the first direction, the third regulating mechanism is switched from the first state to the second state.

Hereinafter, a typical embodiment of a driving machine having the third regulating mechanism will be described with reference to the drawings. In each drawing, elements having the same function are denoted by the same reference numerals.

First Embodiment

A driving machine 10 shown in FIG. 1: has a housing 11; a hitting part 12; a magazine 13; an electric motor 14; a conversion mechanism 15; a control board 16; a battery pack 17; and a weight 18. The housing 11 has a cylindrical main body part 19, a handle 20 connected to the main body part 19, and a motor case 21 connected to the main body part 19. An attaching part 22 is connected to the handle 20 and the motor case 21. An ejecting unit 23 is provided outside the main body part 19, and the ejecting unit 23 is fixed to the main body part 19. The ejecting unit 23 has an ejecting path 24. A user can grip the handle 20 with his/her hand(s), and press a tip of the ejecting unit 23 against a workpiece (struck object) W1.

The magazine 13 is supported by the motor case 21 and the ejecting unit 23. The motor case 21 is disposed between the handle 20 and the magazine 13 in a direction of an axis A1. The magazine 13 accommodates a plurality of fasteners 25. The fastener 25 includes a nail, and quality of a material of the fastener 25 includes metal, non-ferrous metal, and steel. The fasteners 25 are connected to each other by connecting elements. The connecting element may be any of a wire, an adhesive, or a resin. The fastener 25 has a rod shape. The magazine 13 has a feeder. The feeder sends the ejecting path 24 the fastener 25 accommodated in the magazine 13.

The hitting part 12 is provided over an inside and an outside of the main body part 19. The hitting unit 12 has a plunger 26 disposed in the main body part 19, and a driver blade 27 fixed to the plunger 26. The plunger 26 is made of metal or synthetic resin. The plunger 26 has a contacting part 32. A chamfered part 33 is formed on an outer surface of the contacting part 32. The chamfered part 33 is curved.

Figure 2:
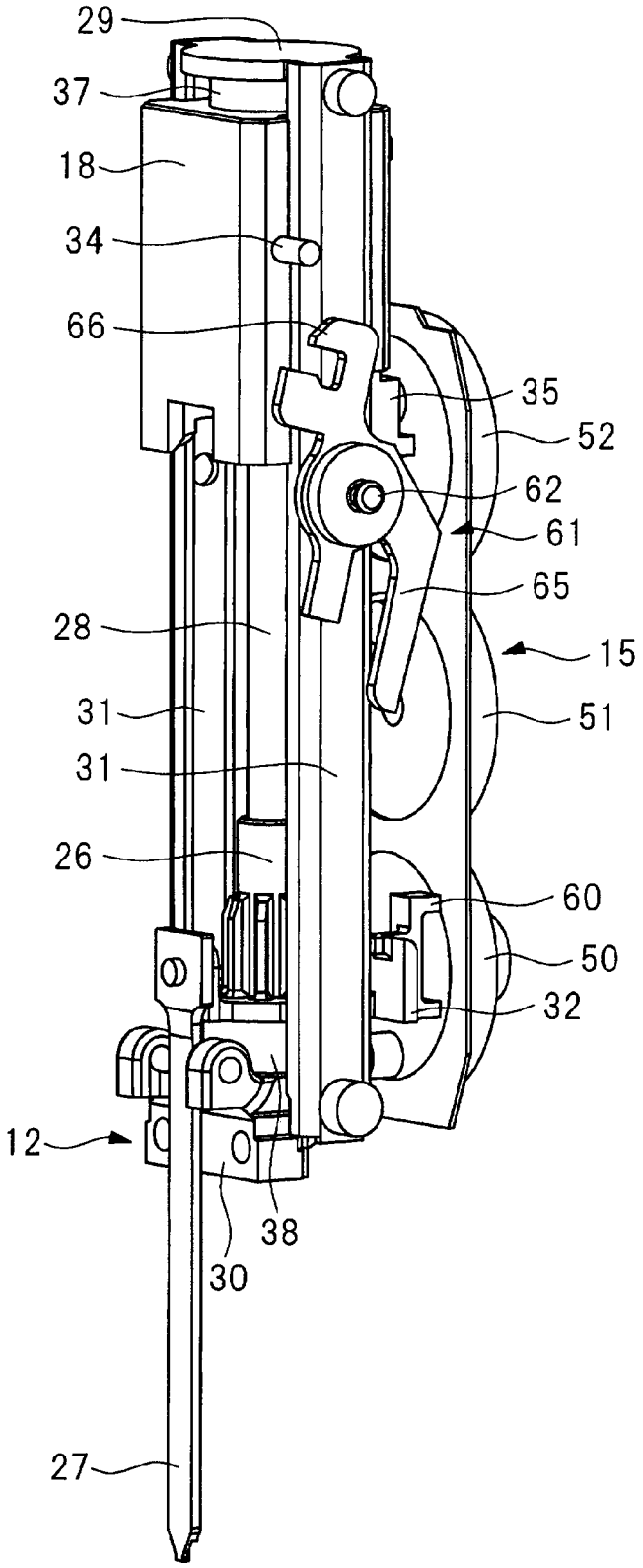
FIG. 2 is a perspective view of a hitting part, a weight, and a drive mechanism that are provided in the driving machine of FIG. 1.
Figure 3:
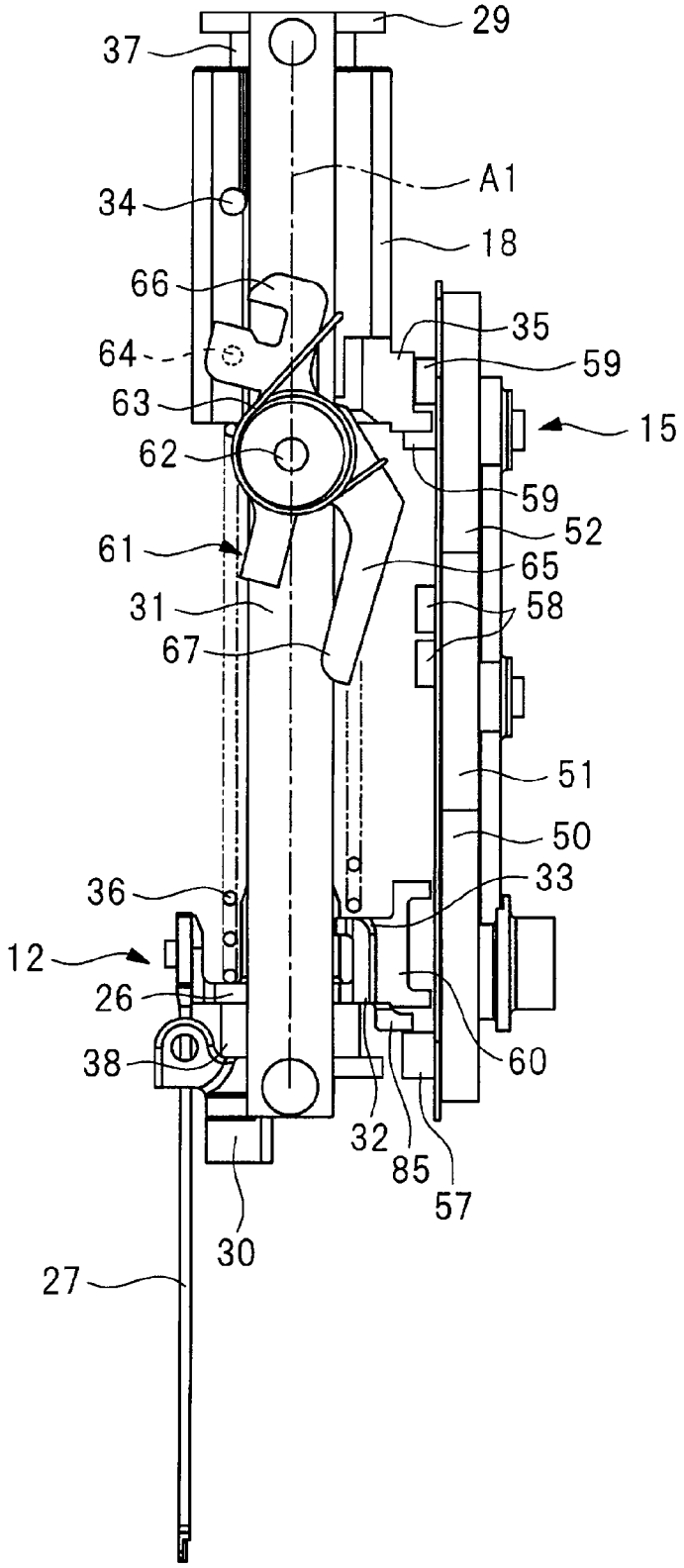
FIG. 3 is a side view of the hitting portion, weight, and drive mechanism that are provided in the driving machine of FIG. 1.
Figure 4:
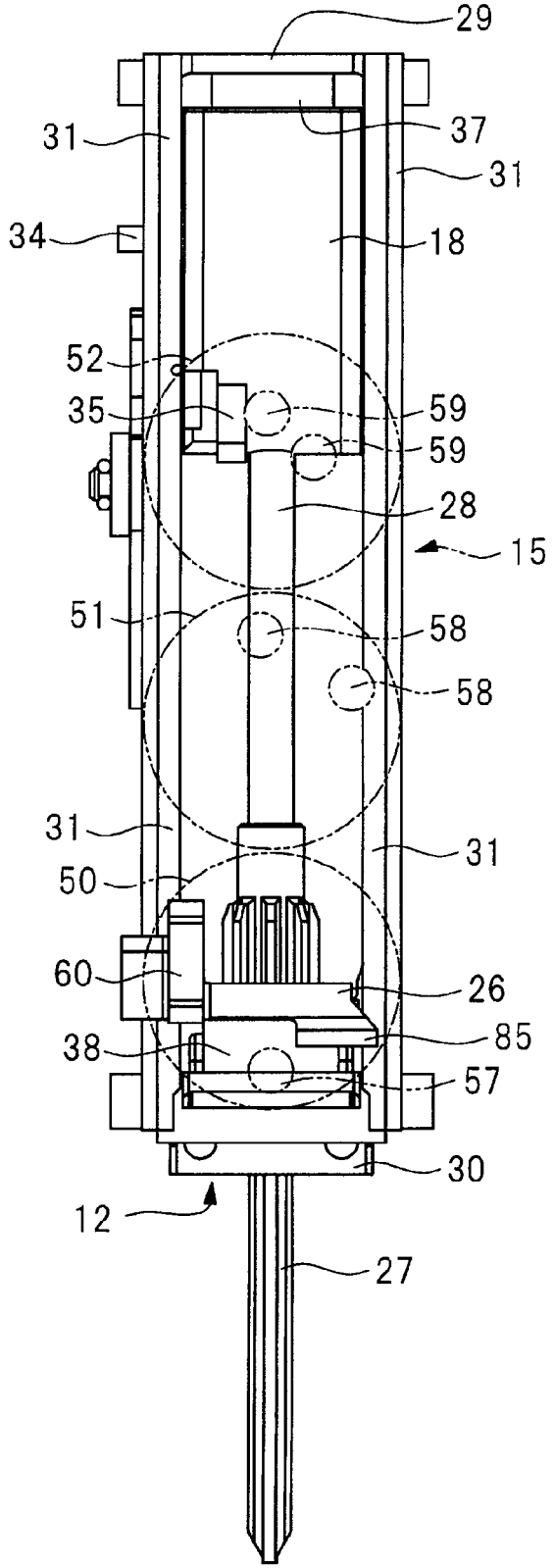
FIG. 4 is a rear view of the hitting part and weight that are provided in the driving machine of FIG. 1.

The driver blade 27 is made of metal. A guide shaft 28 is provided in the main body part 19. An axis A1 passes through a center of the guide shaft 28. Quality of a material of the guide shaft 28 may be any of metal, non-ferrous metal, and steel. As shown in FIGS. 2, 3 and 4, a top holder 29 and a bottom holder 30 are fixedly provided in the housing 11. Quality of each material of the top holder 29 and the bottom holder 30 may be any of metal, non-ferrous metal, and steel. The guide shaft 28 is fixed to the top holder 29 and the bottom holder 30. A guide bar 31 is provided in the main body part 19. Two guide bars 31 are provided, and the two guide bars 31 are fixed to the top holder 29 and the bottom holder 30. The two guide bars 31 are both plate-shaped, and arranged in parallel with the axis A1.

The plunger 26 is attached to an outer peripheral surface of the guide shaft 28, and the plunger 26 is operable along the guide shaft 28 in a direction of the axis A1. The guide shaft 28 positions the plunger 26 in a radial direction centered about the axis A1. The guide bar 31 positions the plunger 26 in a circumferential direction centered around the axis A1. The driver blade 27 is operable together with the plunger 26 in parallel to the axis A1. The driver blade 27 is operable in the ejecting path 24.

The weight 18 suppresses a recoil to which the housing 11 is subjected. Quality of a material of the weight 18 may be any of metal, non-ferrous metal, steel, and ceramic. The weight 18 is attached to the guide shaft 28. The weight 18 has a cylindrical shape as an example, and a pin 34 and a weight arm part 35 are provided on the weight 18. The weight 18 is operable along the guide shaft 28 in the direction of the axis A1. The guide shaft 28 positions the weight 18 in the radial direction centered about the axis A1.

The guide bar 31 positions the weight 18 in the circumferential direction centered around the axis A1.

A spring 36 is disposed in the main body part 19, and the spring 36 is disposed between the plunger 26 and the weight 18 in the direction of the axis A1. As one example, a metal compression coil spring is usable instead of the spring 36. The spring 36 is stretchable in the direction of the axis A1. A first end part of the spring 36 in the direction of the axis A1 contacts with the plunger 26 directly or indirectly. A second end part of the spring 36 in the direction of the axis A1 contacts with the weight 18 directly or indirectly. The spring 36 receives a compressive force in the direction of the axis A1 and accumulates elastic energy. The spring 36 is an example of the energizing mechanism for energizing the hitting part 12 and the weight 18.

The plunger 26 receives, from the spring 36, an energizing force in a first direction D1 of approaching the bottom holder 30 in the direction of the axis A1. The weight 18 receives, from the spring 36, an energizing force in a second direction D2 of approaching the top holder 29 in a direction extending along the axis A1. The first direction D1 and the second direction D2 are opposite to each other, and the first direction D1 and the second direction D2 are parallel to the axis A1. The plunger 26 and the weight 18 receive the energizing force from the spring 36 which is a physically identical element.

A weight bumper 37 and a plunger bumper 38 are provided in the main body part 19. The weight bumper 37 is disposed between the top holder 29 and the weight 18. The plunger bumper 38 is disposed between the bottom holder 30 and the plunger 26. The weight bumper 37 and the plunger bumper 38 are both made of synthetic rubber.

The driving machine 10 shown in FIG. 1 represents an example of a state where the axis A1 is parallel to a vertical line. An operation of the hitting part 12, plunger 26, or weight 18 in the first direction D1 is referred to as descent. In FIG. 1, an operation of the hitting part 12, plunger 26, or weight 18 in the second direction D2 is referenced to as ascent. The hitting part 12 and the weight 18 reciprocably operate in the direction of the axis A1.

The battery pack 17 shown in FIG. 1 is attachable to and detachable from the attaching part 22. The battery pack 17 has an accommodating case 39, and a plurality of battery cells housed in the accommodating case 39. The battery cell is a secondary battery that is rechargeable and dischargeable. Used as the battery cell can be any of a lithium ion battery, a nickel hydride battery, a lithium ion polymer battery, and a nickel cadmium battery. The battery pack 17 is a DC power supply, and electric power of the battery pack 17 can be supplied to the electric motor 14.

Figure 5:
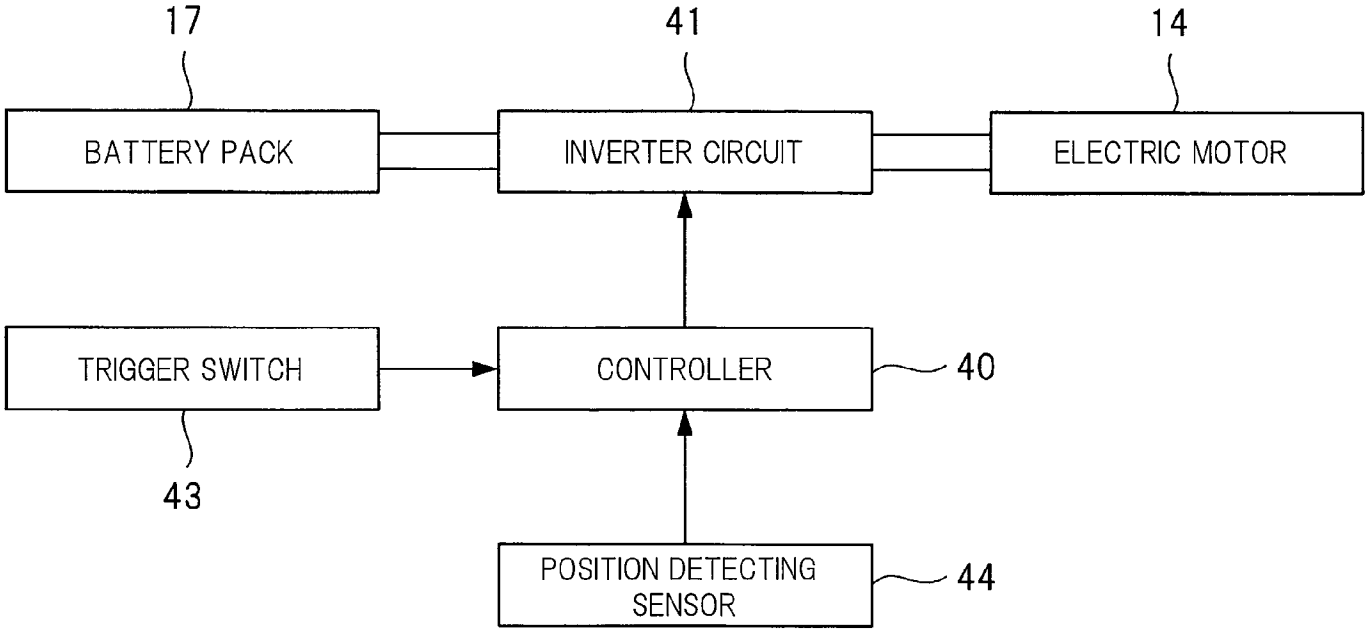
FIG. 5 is a block diagram showing a control system of the driving machine of FIG. 1.

The control board 16 shown in FIG. 1 is provided in the attaching part 22, and a controller 40 and an inverter circuit 41 shown in FIG. 5 are provided on the control board 16. The controller 40 is a microcomputer having an input port, an output port, an arithmetic processing unit, and a storage unit. The inverter circuit 41 has a plurality of switching elements, and the plurality of switching elements can be turned on and off, respectively. The controller 40 outputs a signal for controlling the inverter circuit 41. An electric circuit is formed between the battery pack 17 and the electric motor 14. The inverter circuit 41 is a part of the electric circuit, and connects and disconnects (shuts off) the electric circuit.

As shown in FIG. 1, a trigger 42 and a trigger switch 43 are provided on the handle 20, and when the user applies an operating force to the trigger 42, the trigger switch 43 is turned on. When the user releases the operating force applied to the trigger 42, the trigger switch 43 is turned off. A position detecting sensor 44 shown in FIG. 5 is provided in the housing 11. The position detecting sensor 44 estimates positions of the plunger 26 and the weight 18 in the direction of the axis A1 based on, e.g., a rotational angle of the electric motor 14, and outputs a signal. The controller 40 receives a signal of the trigger switch 43 and the signal of the position detecting sensor 44, and outputs a signal for controlling the inverter circuit 41.

The electric motor 14 has a rotor 84 and a stator 45, and a motor shaft 46 is attached to the rotor 84. When electric power is supplied from the battery pack 17 to the electric motor 14, the motor shaft 46 rotates. A speed reducer 47 is disposed in the motor case 21. The speed reducer 47 has a plurality of sets of planetary gear mechanisms, an input element 48, and an output element 49. The input element 48 is connected to the motor shaft 46. The electric motor 14 and the speed reducer 47 are arranged concentrically so as to be centered about an axis B1. The driving machine 10 shown in FIG. 1 illustrates an example in which an angle between the axis A1 and the axis B1 is 90 degrees.

The conversion mechanism 15 converts a rotative force of the output element into the operating force of the hitting part 12 and the operating force of the weight 18. The conversion mechanism 15 has a first gear 50, a second gear 51, and a third gear 52. Quality of each material of the first gear 50, second gear 51, and third gear 52 may be any of metal, non-ferrous metal, and steel. A holder 53 is provided in the housing 11, and the output element 49 is rotatably supported by the holder 53. The first gear 50 is fixed to the output element 49. The second gear 51 is rotatably supported by a supporting shaft 54. The third gear 52 is rotatably supported by a supporting shaft 55. The supporting shafts 54, 55 are attached to the holder 53. The first gear 50 is rotatable so as to be centered about the axis B1; the second gear 51 is rotatable so as to be centered about an axis B2; and the third gear 52 is rotatable so as to be centered about an axis B3.

As shown in FIG. 1, the axes B1, B2, B3 are spaced (arranged) at intervals in the direction of the axis A1. The axis B2 is placed between the axis B1 and the axis B3. The axes B1, B2, B3 are parallel to each other. The third gear 52 is disposed between the second gear 51 and the top holder 29 in the direction of the axis A1. The first gear 50 is placed between the second gear 51 and the magazine 13 in the direction of the axis A1. As shown in FIG. 4, an outer diameter of the first gear 50, an outer diameter of the second gear 51, and an outer diameter of the third gear 52 are the same. The second gear 51 meshes with the first gear 50 and the third gear 52.

As shown in FIGS. 3 and 4, a cam roller 57 is provided on the first gear 50; two cam rollers 58 are provided on the second gear 51; and two cam rollers 59 are provided on the third gear 52. The cam roller 57 is rotatable with respect to the first gear 50. The two cam rollers 58 are arranged on the same circumference centered about the axis B2. The two cam rollers 58 are rotatable with respect to the second gear 51, respectively. The two cam rollers 59 are rotatable with respect to the third gear 52, respectively. The two cam rollers 59 are arranged on the same circumference centered about the axis B3. Quality of each material of the cam rollers 57, 58, 59 may be any of metal, non-ferrous metal, and steel.

When the electric power of the battery pack 17 is supplied to the electric motor 14 and the motor shaft 46 rotates forward (positively), the rotative force of the motor shaft 46 is transmitted to the first gear 50 via the speed reducer 47. When the first gear 50 in FIG. 4 rotates counterclockwise, the second gear 51 rotates clockwise and the third gear 52 rotates counterclockwise. The electric motor 14, speed reducer 47, and conversion mechanism 15 constitute a drive mechanism 83.

As shown in FIGS. 3 and 4, a first arm part 85 and a second arm part 60 are provided on the plunger 26. The first arm part 85 and the second arm part 60 are made of metal. When the first gear 50 rotates counterclockwise in FIG. 4, the cam roller 57 is engageable with and releasable (disengageable) from the first arm part 85. When the second gear 51 rotates clockwise, the cam roller 58 is engageable with and releasable from the second arm part 60. When the third gear 52 rotates, the cam roller 59 is engageable with and releasable from a weight arm part 35.

As shown in FIGS. 1, 2, and 3, a latch 61 is attached to the guide bar 31. The latch 61 is rotatable so as to be centered about the supporting shaft 62 with respect to the guide bar 31. As one example, the supporting shaft 62 is disposed within an arrangement range of the third gear 52 in the direction of the axis A1.

Further, as shown in FIGS. 1 and 3, a metal spring 63 is attached to the latch 61. The spring 63 is, for example, a torsion coil spring. A first end part of the spring 63 in its winding direction is engaged with the latch 61, and a second end part of the spring 63 in the winding direction is engaged with the guide bar 31. The spring 63 energizes the latch 61 in a clockwise direction centered about the supporting shaft 62. A stopper 64 is provided on the latch 61, and when the stopper 64 contacts with the guide bar 31, the latch 61 stops. The latch 61 has an arm 65 and a hook 66. The arm 65 and the hook 66 are arranged across (separately from) the supporting shaft 62 in a longitudinal direction of the latch 61. The hook 66 is located between the top holder 29 and the supporting shaft 62 in the direction of the axis A1. The arm 65 is located between the bottom holder 30 and the supporting shaft 62 in the direction of the axis A1. The hook 66 is contactable with and separable from the pin 34. Specifically, the hook 66 is engageable with and disengageable (releaseable) from the pin 34. The arm 65 is contactable with and separable from the contacting part 32. The chamfered part 67 is formed on an outer surface of the arm 65. The chamfered part 67 is curved. The latch 61 and the spring 63 constitute a third regulating mechanism 71.

Figure 6:
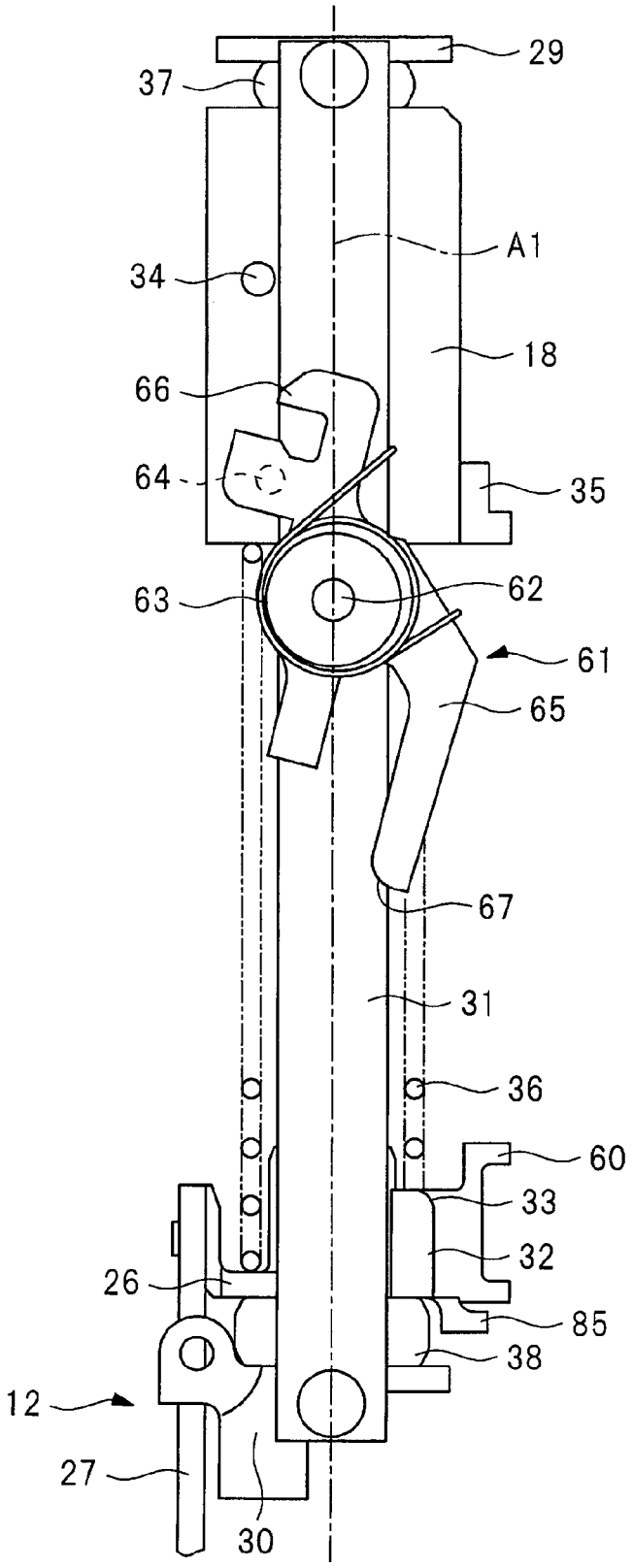
FIG. 6 is a side view of a state where the hitting part is located at a bottom dead center and the weight is located at a top dead center in a first embodiment of the driving machine.

Next, a usage example of the driving machine 10 will be described. When detecting that the trigger switch 43 is turned off, the controller 40 supplies no electric power to the electric motor 14 and stops the motor shaft 46. When the electric motor 14 is stopped, as shown in FIG. 6, the plunger 26 is stopped at a position of contacting with the plunger bumper 38, i.e., at a bottom dead center. Additionally, the weight 18 is energized due to the elastic force of the spring 36, and is stopped at a position of contacting with the weight bumper 37, i.e., at a top dead center.

Further, the stopper 64 contacts with the guide bar 31, and the latch 61 is stopped. Additionally, the arm 65 is separated from the contacting part 32, and the hook 66 is released from the pin 34. The controller 40 estimates the positions of the plunger 26 and the weight 18 in the direction of the axis A1 by processing the signal of the position detecting sensor 44.

Further, when the plunger 26 stops at the bottom dead center, the cam rollers 57, 58 are separated from the second arm part 60. When the weight 18 stops at the top dead center, the cam roller 59 is separated from the weight arm part 35.

When the user presses a tip of the ejecting unit 23 against the workpiece W1 and the controller 40 detects that the trigger switch 43 is turned on, the controller 40 supplies electric power to the electric motor 14 to rotate the motor shaft 46 forward. The rotative force of the motor shaft 46 is amplified by the speed reducer 47 and transmitted to the first gear 50, and the first gear 50 rotates counterclockwise in FIG. 4.

Figure 7:
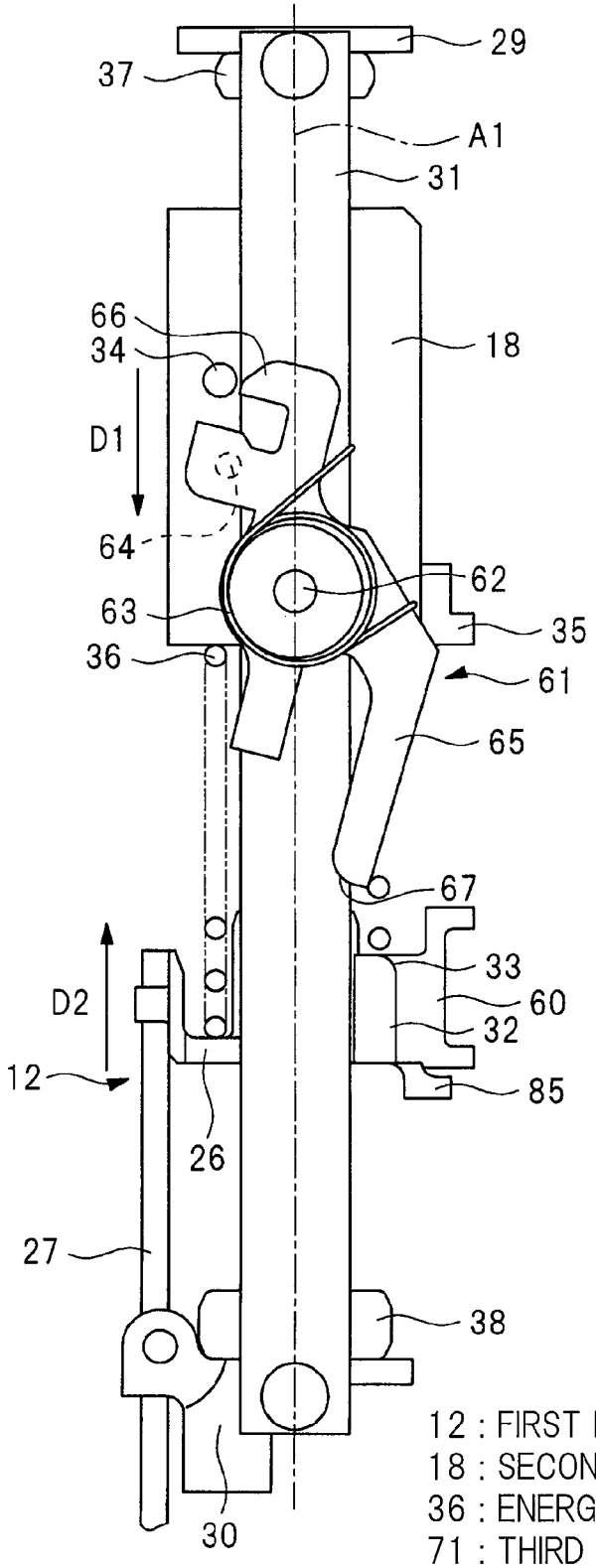
FIG. 7 is a side view of a state where the hitting part ascends from the bottom dead center and the weight descends from the top dead center in the driving machine according to the first embodiment.

When the first gear 50 rotates counterclockwise, the second gear 51 rotates clockwise and the third gear 52 rotates counterclockwise. When the first gear 50 rotates counterclockwise and the cam roller 57 is engaged with the first arm part 85, the plunger 26 operates in a second direction D2 against the energizing force of the spring 36 as shown in FIG. 7. That is, the hitting part 12 ascends. Additionally, when the third gear 52 rotates counterclockwise and the cam roller 59 is engaged with the weight arm part 35, the weight 18 operates in the first direction D1. That is, the weight 18 descends.

During rotation of the first gear 50 and the second gear 51, when the cam roller 57 is engaged with the first arm part 85, one cam roller 58 is engaged with the second arm part 60. Thereafter, the cam roller 57 is released from the first arm part 85. Further, when one cam roller 58 is engaged with the second arm part 60, the other cam roller 58 is engaged with the second arm part 60. Next, the cam roller 58 previously engaged with the second arm part 60 is released from the second arm part 60.

Figure 8:
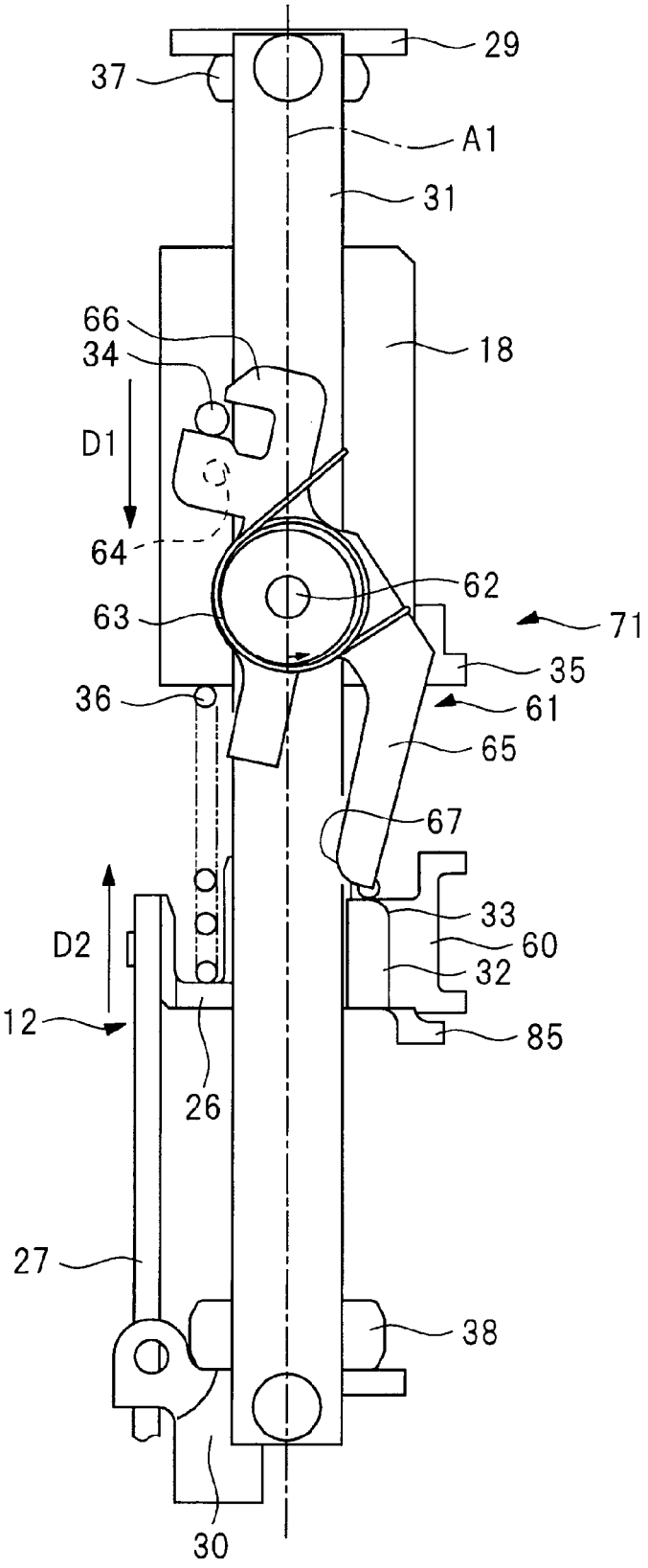
FIG. 8 is a side view of a state where the hitting part further ascends from a location shown in FIG. 7 and the weight further descends from a location shown in FIG. 7.
Figure 9:
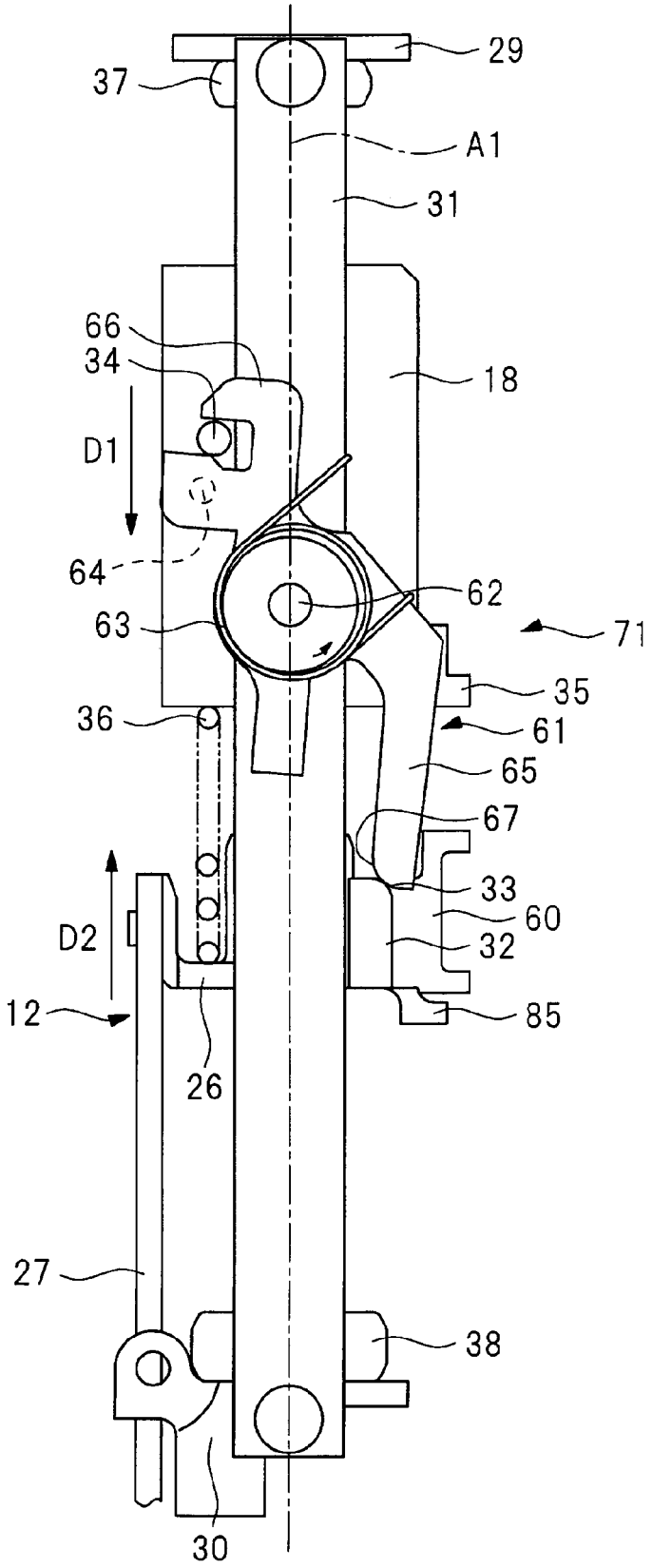
FIG. 9 is a side view of a state where the hitting part further ascends from a location shown in FIG. 8 and the weight reaches the bottom dead center.

Then, as shown in FIG. 8, when the pin 34 contacts with the latch 61 and the weight 18 descends, the latch 61 operates counterclockwise against the energizing force of the spring 63. Further, when the plunger 26 ascends and the contacting part 32 contacts with the arm 65 as shown in FIG. 9, the latch 61 operates further counterclockwise against the energizing force of the spring 63 and the hook 66 is engaged with the pin 34. When the arm 65 contacts with the contacting part 32, the chamfered part 67 and the chamfered part 33 contact with each other, so that the latch 61 smoothly operates counterclockwise.

Figure 10:
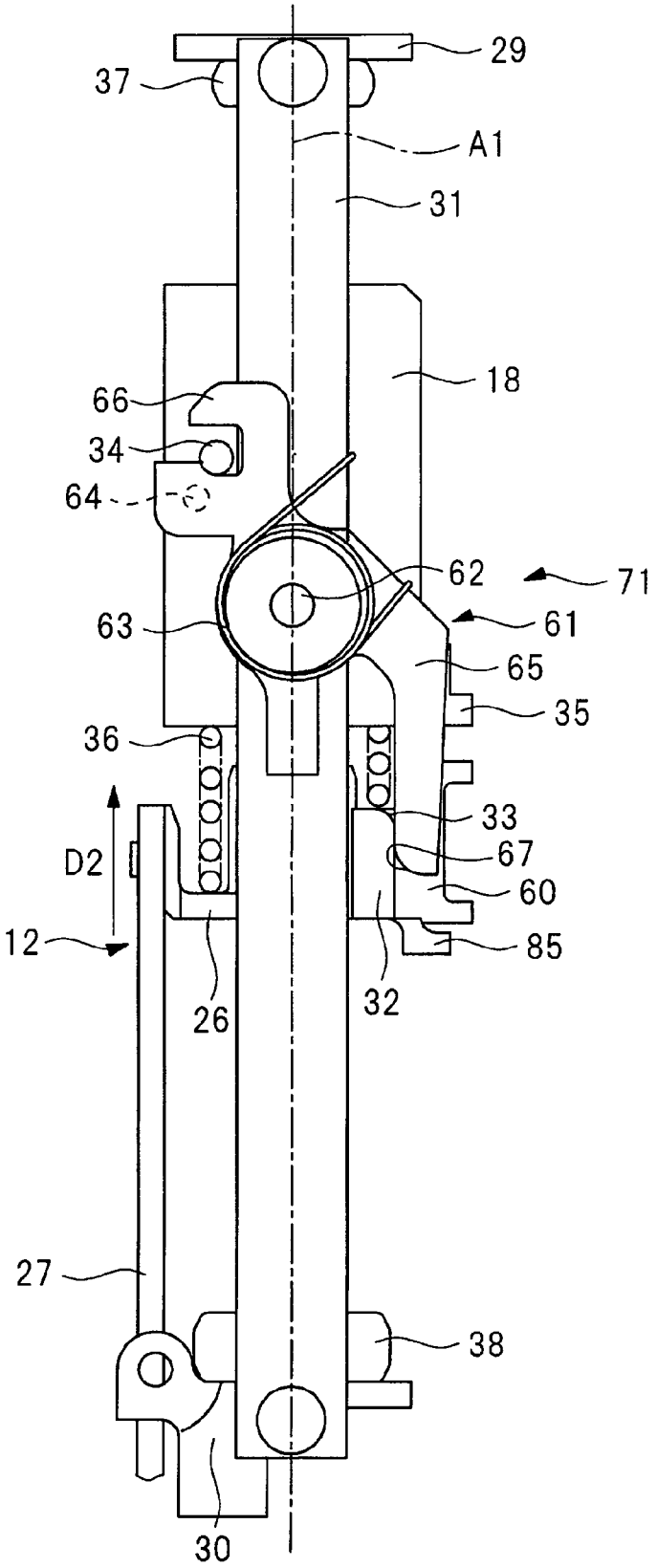
FIG. 10 is a side view of a state where the hitting part further ascends from a location shown in FIG. 9 and the weight stops at the bottom dead center.
Figure 11:
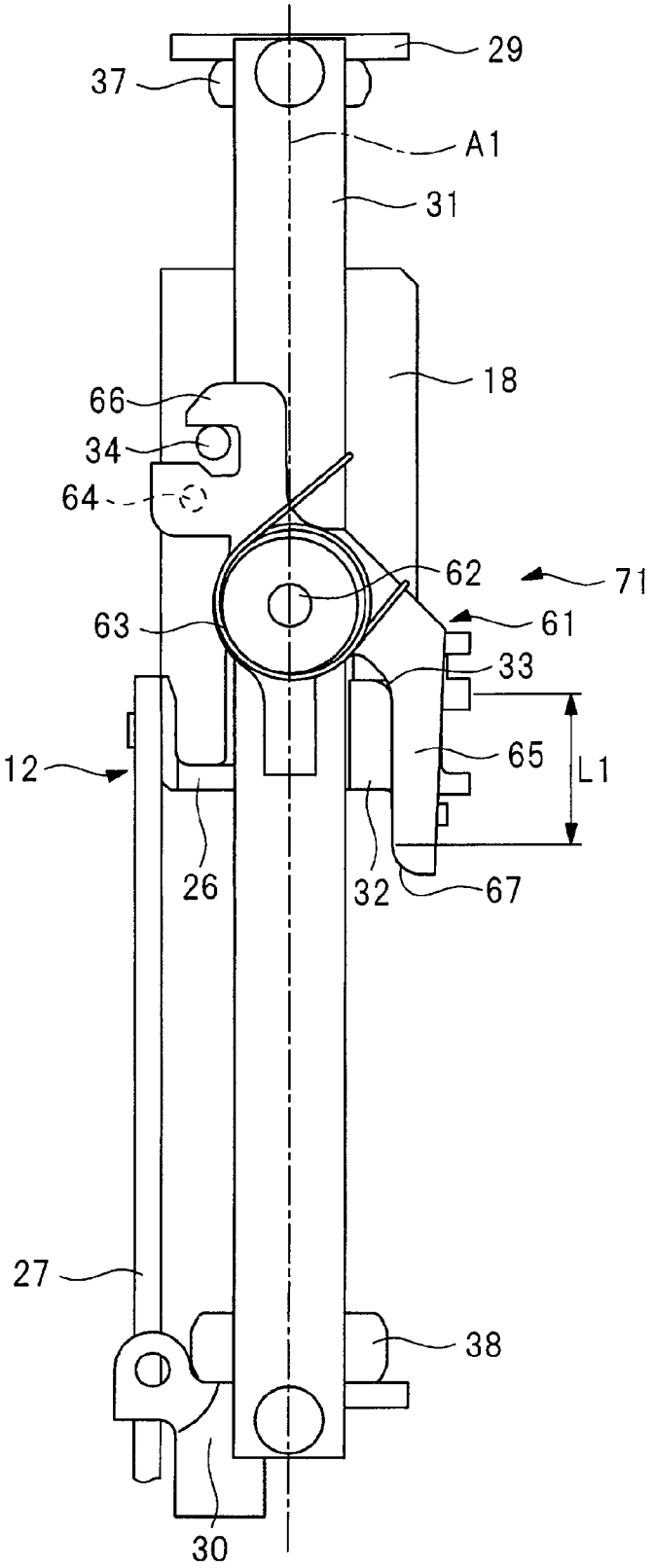
FIG. 11 is a side view of a state where the hitting part reaches the top dead center and the weight stops at the bottom dead center.

Next, as shown in FIG. 10, the weight 18 reaches the bottom dead center, and the plunger 26 further ascends. Additionally, the contacting part 32 is maintained in a state of contacting with the arm 65. Further, the third gear 52 rotates, and the two cam rollers 59 are both released from the weight arm part 35. However, since the contacting part 32 contacts with the arm 65, the latch 61 is stopped. That is, as shown in FIG. 11, the hook 66 is in a state of being engaged with the pin 34, and the weight 18 is stopped.

Then, when the plunger 26 reaches the top dead center, the two cam rollers 58 are both released from the second arm part 60 and the plunger 26 descends due to the energizing force of the spring 36. Even if the plunger 26 starts descending, the latch 61 stops since the contacting part 32 contacts with the arm 65. Consequently, the hook 66 is held in a state of being engaged with the pin 34, and the weight 18 stops.

Figure 12:
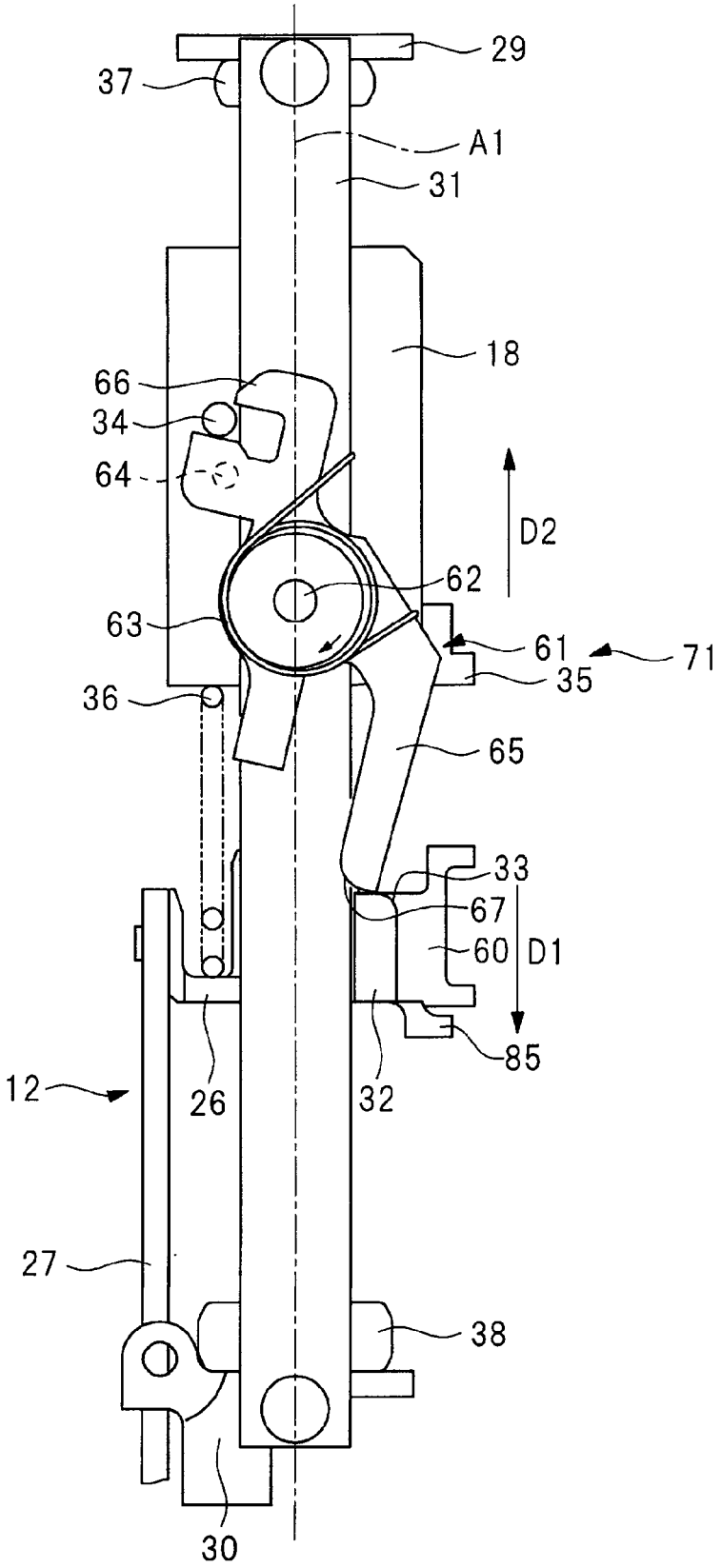
FIG. 12 is a side view of a state where the hitting part descends from the top dead center and the weight ascends from the bottom dead center.

When the plunger 26 further descends and the contacting part 32 is separated from the arm 65 as shown in FIG. 12, the latch 61 operates clockwise due to the energizing force of the spring 63. Consequently, the hook 66 is released from the pin 34, and the weight 18 starts ascending due to the energizing force of the spring 36.

When the plunger 26 descends, that is, when the hitting part 12 descends, the driver blade 27 strikes the fastener 25 located on the ejecting path 24. The fastener 25 is driven into the workpiece W1. After the driver blade 27 strikes the fastener 25, the plunger 26 collides with the plunger bumper 38 as shown in FIG. 6. The plunger bumper 38 absorbs a part of kinetic energy of the hitting part 12. Additionally, the weight 18 collides with the weight bumper 37. The weight bumper 37 absorbs a part of kinetic energy of the weight.

As described above, when the hitting part 12 operates in the first direction and strikes (hits) the fastener 25, the weight 18 operates in the second direction opposite to the first direction. This makes it possible to reduce the recoil that is brought when the hitting part 12 strikes the fastener 25. Therefore, if the relationship between first timing when the plunger 26 starts operating from the top dead center toward the bottom dead center and second timing when the weight 18 starts operating from the bottom dead center toward the top dead center is stabilized, the recoil is easier reduced.

The controller 40 estimates the position of the plunger 26 in the direction of the axis A1, and stops the electric motor 14 during an interval between a descent starting time of the plunger 26 and a colliding time thereof with the plunger bumper 38. Consequently, the plunger 26 stops at the bottom dead center of contacting with the plunger bumper 38, and the weight 18 stops at the top dead center of contacting with the weight bumper 37. Then, when the user releases the operating force applied to the trigger 42 and applies an operating force again to the trigger 42, the controller 40 rotates the electric motor 14 and the hitting part 12 and the weight 18 operate in the same manner as described above.

Figure 13:
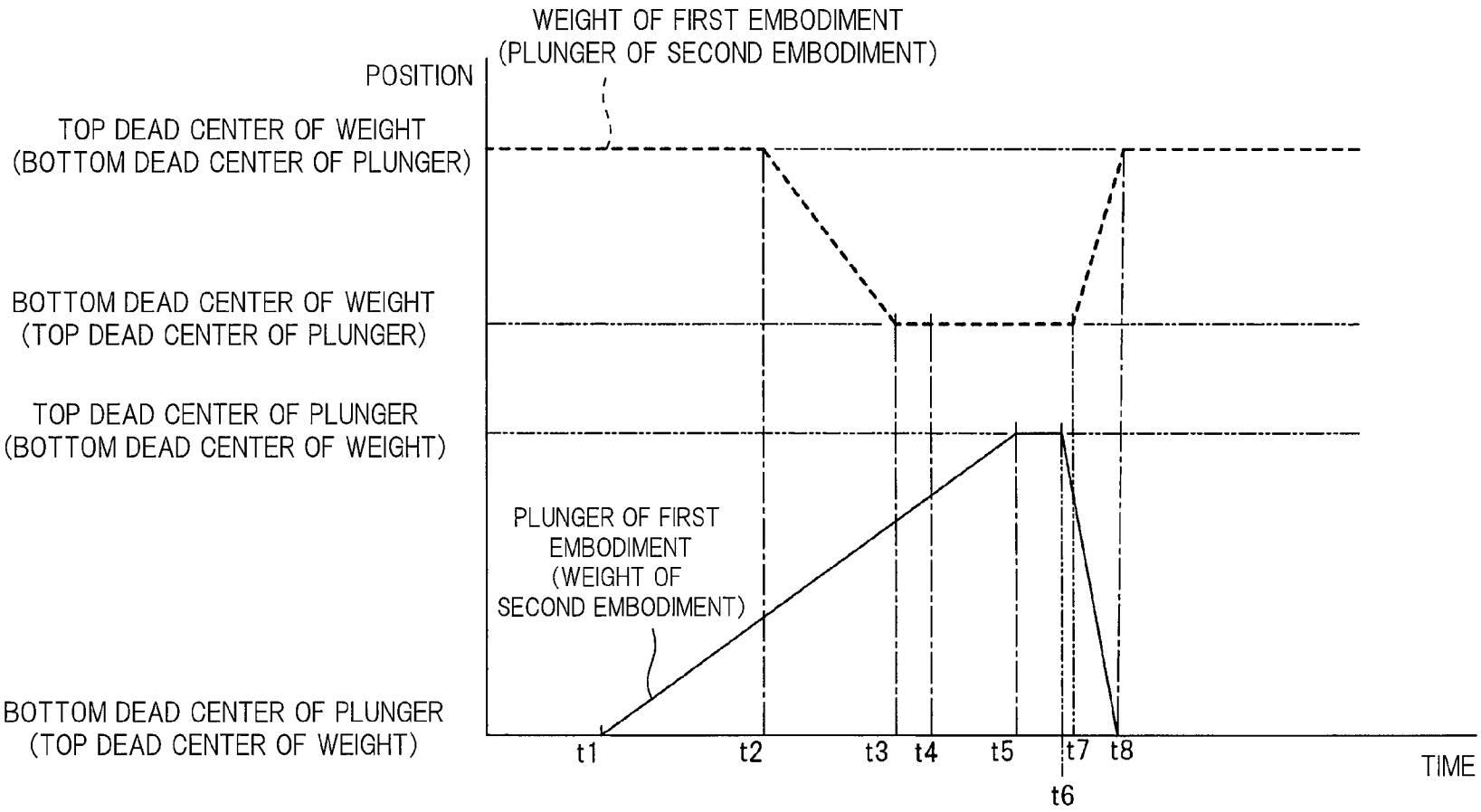
FIG. 13 is a time chart showing operative examples of a plunger of the hitting part and the weight.

FIG. 13 is a time chart illustrating operative examples of the plunger 26 and the weight 18. In the first embodiment of the driving machine 10, the position of the plunger 26 is indicated by a solid line, and the position of the weight 18 is indicated by a broken line. The plunger 26 stops at the bottom dead center before a time t1, and the weight 18 stops at the top dead center before the time t1. The plunger 26 starts operating from the bottom dead center toward the top dead center at the time t1. The weight 18 stops at the top dead center even after the time t1.

The weight 18 starts operating at a time t2 from the top dead center toward the bottom dead center. The weight 18 reaches the bottom dead center at a time t3, and the weight stops at the bottom dead center after the time t3. Further, the hook 66 is engaged with the pin 34 at a time t4, and the latch 61 is in a state of being capable of holding the weight 18. The plunger 26 reaches the top dead center at a time t5, and the plunger 26 stops at the top dead center after the time t5.

The plunger 26 starts descending from the top dead center toward the bottom dead center at a time t6. Since the latch 61 holds the weight 18 at the time t6, the weight 18 stops at the bottom dead center even after the time t6.

When the latch 61 operates at a time t7 and the latch 61 finishes holding the weight 18, the weight 18 starts operating from the bottom dead center toward the top dead center. Then, the plunger 26 reaches the bottom dead center at a time t8, and the weight 18 reaches the top dead center at the time t8. Incidentally, also adopted may be a configuration in which the plunger 26 reaches the bottom dead center at the time t8 and the weight 18 reaches the top dead center later than the time t8.

In the first embodiment of the driving machine 10, the latch 61 operates according to the axis-A1-directional position of the plunger 26 which is an element of the hitting part 12, and the following relationship is determined: the relationship between first timing when the plunger 26 starts operating from the top dead center toward the bottom dead center and second timing when the weight 18 starts operating from the bottom dead center toward the top dead center.

Specifically, when the cam roller 59 is engaged with the weight arm part 35 and the weight 18 stops at the bottom dead center, all the cam rollers 59 are released from the weight arm part 35. Here, when the contacting part 32 is in contact with the arm 65, the latch 61 stops. That is, the latch 61 holds the weight 18 at the bottom dead center. Then, when the plunger 26 starts operating from the top dead center toward the bottom dead center and the plunger 26 reaches a predetermined position, the contacting part 32 is separated from the arm 65 and the latch 61 is operated and then the weight 18 starts operating from the bottom dead center toward the top dead center.

For this reason, a condition(s) of the driving machine 10 can be suppressed so as not to affect the relationship between the first timing and the second timing. The phrase "affecting the relationship between the first timing and the second timing" contains the meaning of "the relationship between the first timing and the second timing is made unstable". In other words, the accuracy of the first timing and the second timing can be improved. Therefore, this makes it possible to realize improvement of the driving feeling of the driving machine 10. The condition of the driving machine 10 includes at least one condition out of variations in respective shapes or dimensions of elements constituting the conversion mechanism 15 and variations in respective assembled states of the elements constituting the conversion mechanism 15.

Further, the first embodiment of the driving machine 10 adopts none of a configuration of increasing a stroke amount of the weight 18 and a configuration of increasing mass of the weight 18 when the relationship between the first timing and the second timing is made stable. Therefore, at least one of increases in size and weight of the driving machine 10 can be avoided.

In the first embodiment of the driving machine 10, timing when the plunger 26 ascends from the bottom dead center is changeable (switchable) or adjustable by setting the number of cam rollers 57 and positions of the cam rollers 57 in a rotational direction of the first gear 50. In the first embodiment of the driving machine 10, timing when the plunger 26 reaches the top dead center is changeable or adjustable by setting a diameter of a circumcircle of the cam roller 58 in a radial direction of the second gear 51. In the first embodiment of the driving machine 10, timing when the plunger 26 descends from the top dead center is changeable or adjustable by setting the number of cam rollers 58 and positions of the cam rollers 58 in a rotational direction of the second gear 51.

In the first embodiment of the driving machine 10, timing when the weight 18 descends from the top dead center is changeable (switchable) or adjustable by setting the number of cam rollers 59 and positions of the cam rollers 59 in a rotational direction of the third gear 52. In the first embodiment of the driving machine 10, timing when the weight 18 reaches the bottom dead center is changeable or adjustable by setting a diameter of a circumcircle of the cam roller 59 in a radial direction of the third gear 52.

As shown in FIG. 11, in the first embodiment of the driving machine 10, timing when the weight 18 ascends from the bottom dead center is changeable or adjustable by setting an axis-A1-directional length of the arm 65 to L1. The timing when the weight 18 ascends from the bottom dead center is definable as a required time between the timing when the plunger 26 descends from the top dead center and the timing when the weight 18 ascends from the bottom dead center. The required time corresponds to a time between the time t6 and the time t7 in the time chart of FIG. 13. A length L1 of the arm 65 is such a value that the contacting part 32 prevents the latch 61 from operating when the arm 65 is in contact with the contacting part 32. For example, as the length L1 of the arm 65 is set relatively shorter, the required time becomes relatively shorter.

Second Embodiment

Figure 14:
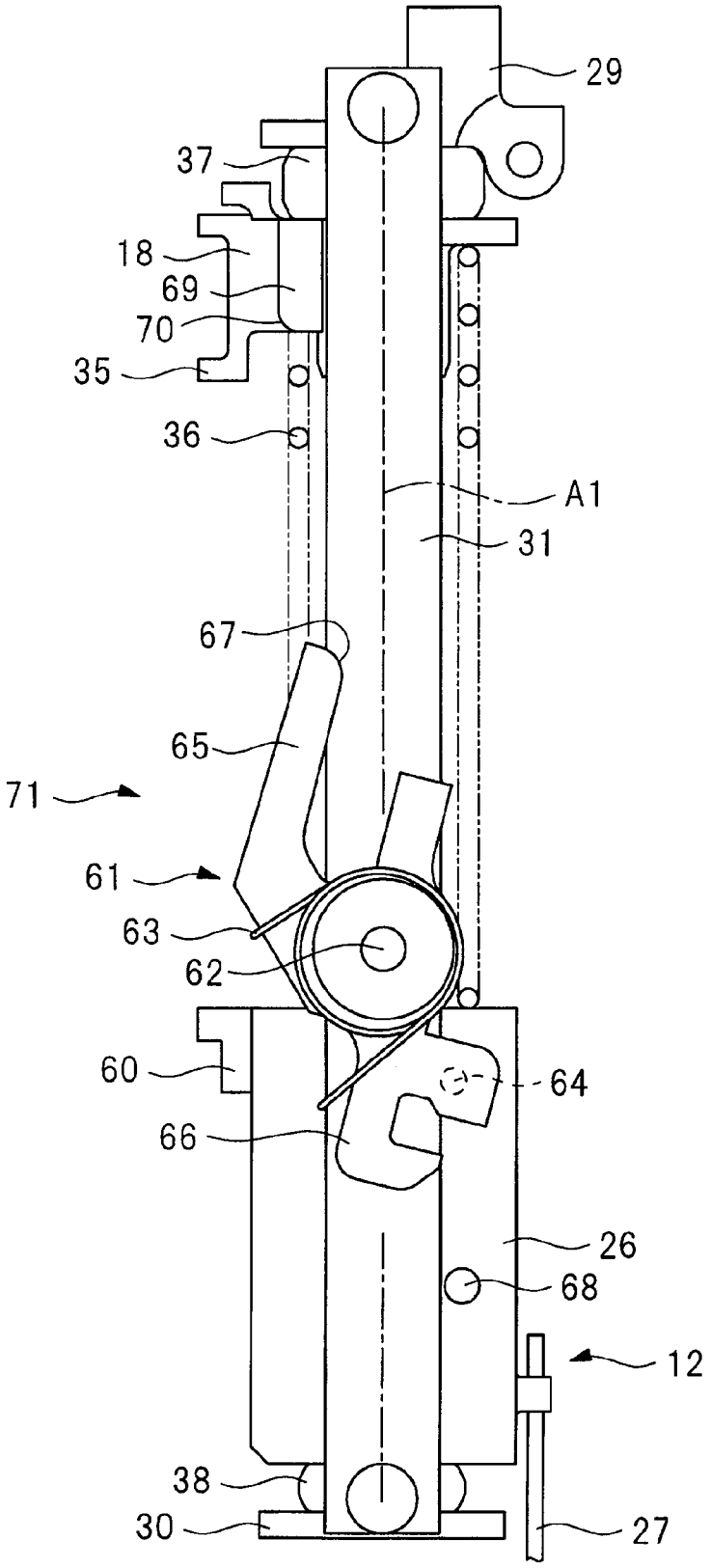
FIG. 14 is a side view of a state where a hitting part is located at a bottom dead center and a weight is located at a top dead center in a second embodiment of the driving machine.

A second embodiment of the driving machine having the third regulating mechanism will be described with reference to FIG. 14. A pin 68 is provided on the plunger 26. The pin 34 shown in FIG. 6 is not provided on the weight 18 of FIG. 14. A contacting part 69 is provided on the weight 18, and a chamfered part 70 is formed on an outer surface of the contacting part 69. The chamfered part 70 is curved. The contacting part 32 shown in FIG. 6 is not provided on the plunger 26 of FIG. 14.

A supporting shaft 62 that supports the latch 61 is disposed at a position closer to the bottom holder 30 than a middle between the top holder 29 and the bottom holder 30 in the direction of the axis A1. The arm 65 of the latch 61 is located between the top holder 29 and the supporting shaft 62 in the direction of the axis A1. The hook 66 of the latch 61 is located between the bottom holder 30 and the supporting shaft 62 in the direction of the axis A1. The latch 61 is energized clockwise so as to be centered about the supporting shaft 62 shown in FIG. 14 by the spring 63. The plunger 26, weight 18, and latch 61 shown in FIG. 14 can be provided in the driving machine 10 shown in FIG. 1, and the driving machine 10 having such a configuration is the second embodiment.

In the second embodiment of the driving machine 10, the cam roller 57 of the first gear 50 shown in FIG. 4 is engageable with and releaseable (disengageable) from the first arm part 85, and the cam roller 58 of the second gear 51 is engageable with and releaseable from the second arm part 60. In the second embodiment of the driving machine 10, the cam roller 59 of the third gear 52 is engageable with and releaseable from the weight arm part 35.

A usage example of the driving machine 10 according to the second embodiment will be described. When the electric motor 14 shown in FIG. 1 is stopped, the plunger stops at the bottom dead center as shown in FIG. 14 and the weight 18 stops at the top dead center. Further, the stopper 64 contacts with the guide bar 31, and the latch 61 stops. Further, the arm 65 is separated from the contacting part 69, and the hook 66 is released from the pin 68.

Figure 15:
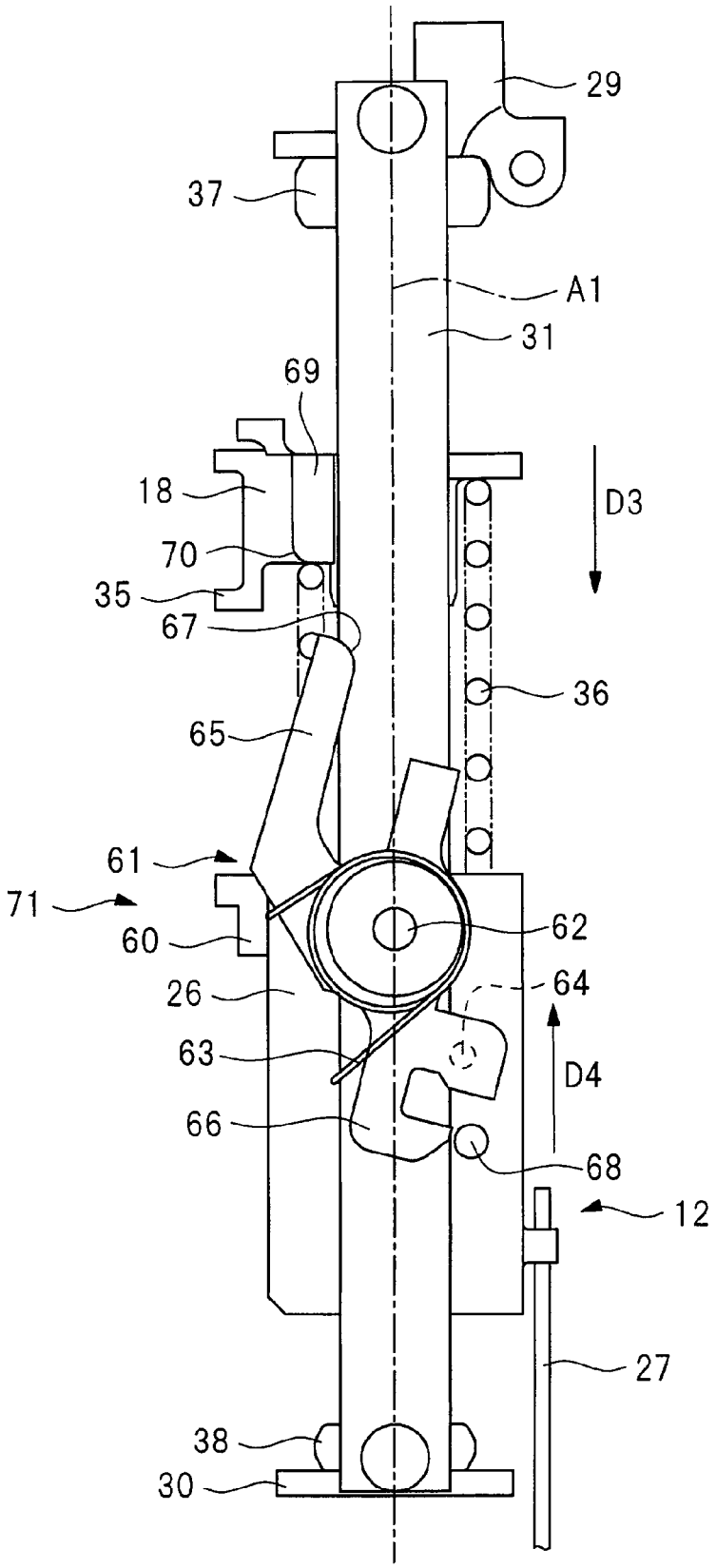
FIG. 15 is a side view of a state where the hitting part ascends from the bottom dead center and the weight descends from the top dead center in the second Embodiment of the driving machine.

When the electric motor 14 shown in FIG. 1 rotates, the weight 18 operates in a second direction D3 against the energizing force of the spring 36 as shown in FIG. 15 similarly to the first embodiment of the driving machine 10. That is, the weight 18 descends. Further, similarly to the first embodiment of the driving machine 10, the plunger 26 shown in FIG. 15 operates in a first direction D4. That is, the plunger 26 ascends. The first direction D4 and the second direction D3 are parallel to the axis A1.

Figure 16:
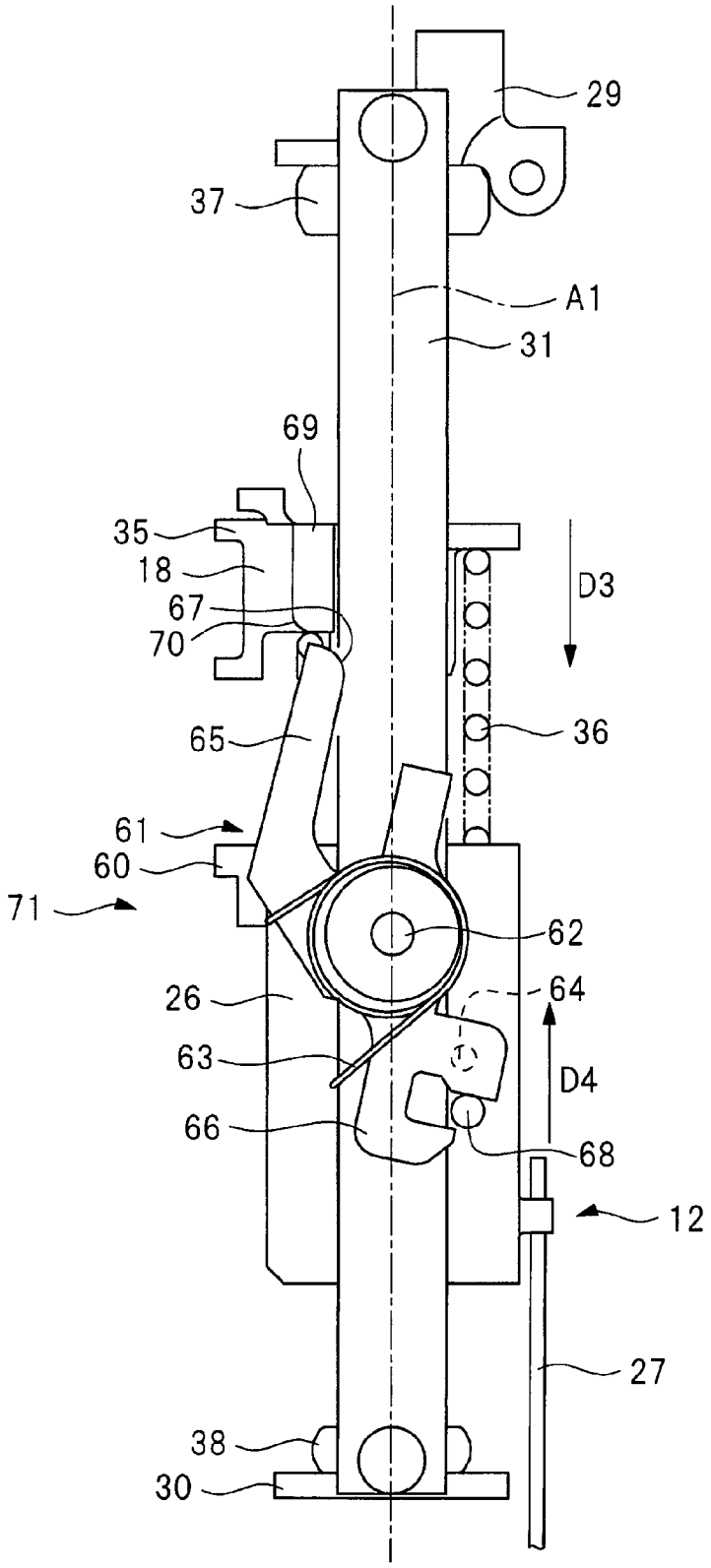
FIG. 16 is a side view of a state where the hitting part further ascends from a location shown in FIG. 15 and the weight further descends from a location shown in FIG. 15.
Figure 17:
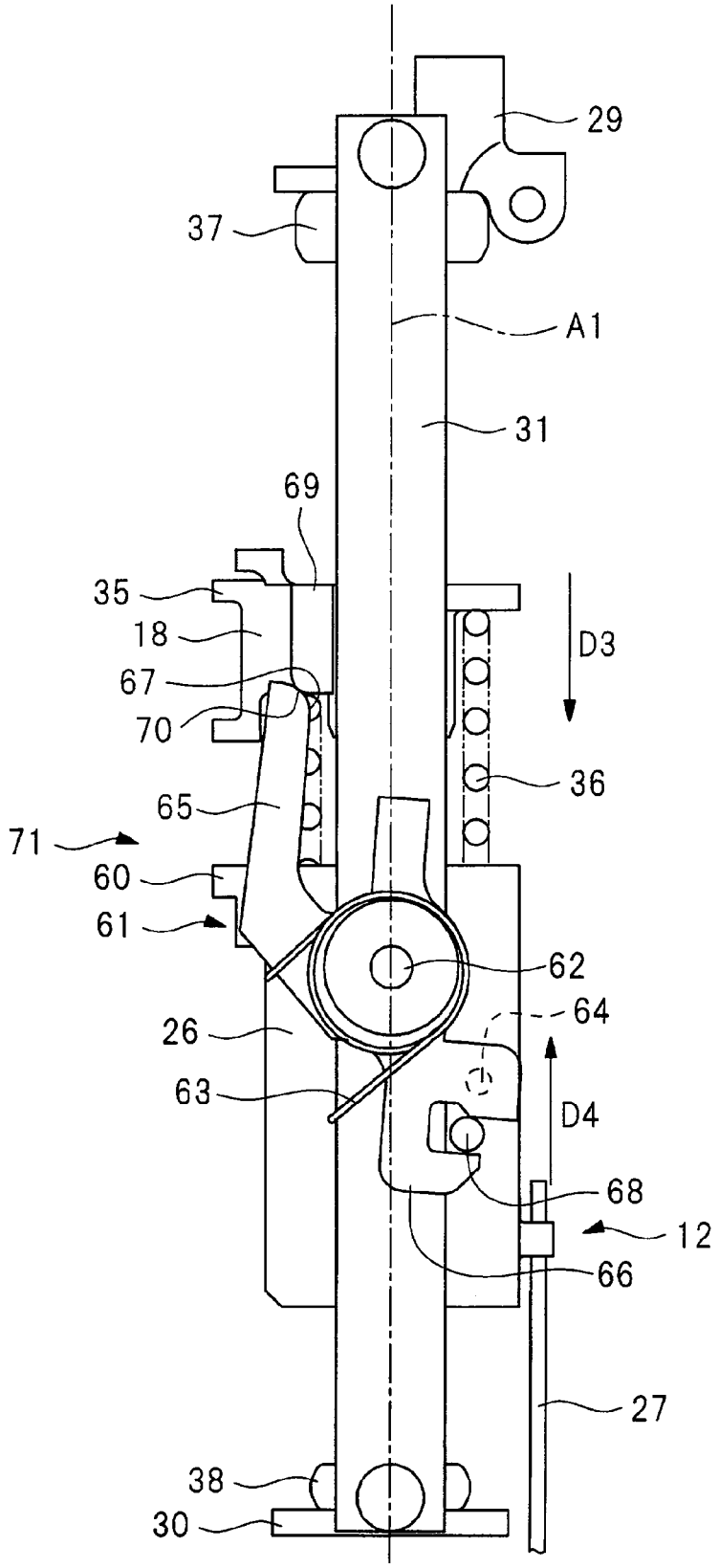
FIG. 17 is a side view of a state where the weight further descends from a location shown in FIG. 16 and the hitting part reaches the top dead center.

Then, as shown in FIG. 16, when the pin 68 contacts with the latch 61 and the plunger 26 ascends, the latch 61 operates counterclockwise against the energizing force of the spring 63. Further, when the weight 18 descends and the contacting part 69 contacts with the arm 65 as shown in FIG. 17, the latch 61 operates further counterclockwise against the energizing force of the spring 63 and the hook 66 is engaged with the pin 68. When the contacting part 69 contacts with the arm 65, the chamfered part 70 and the chamfered part 67 contact with each other, so that the latch 61 smoothly operates counterclockwise.

Figure 18:
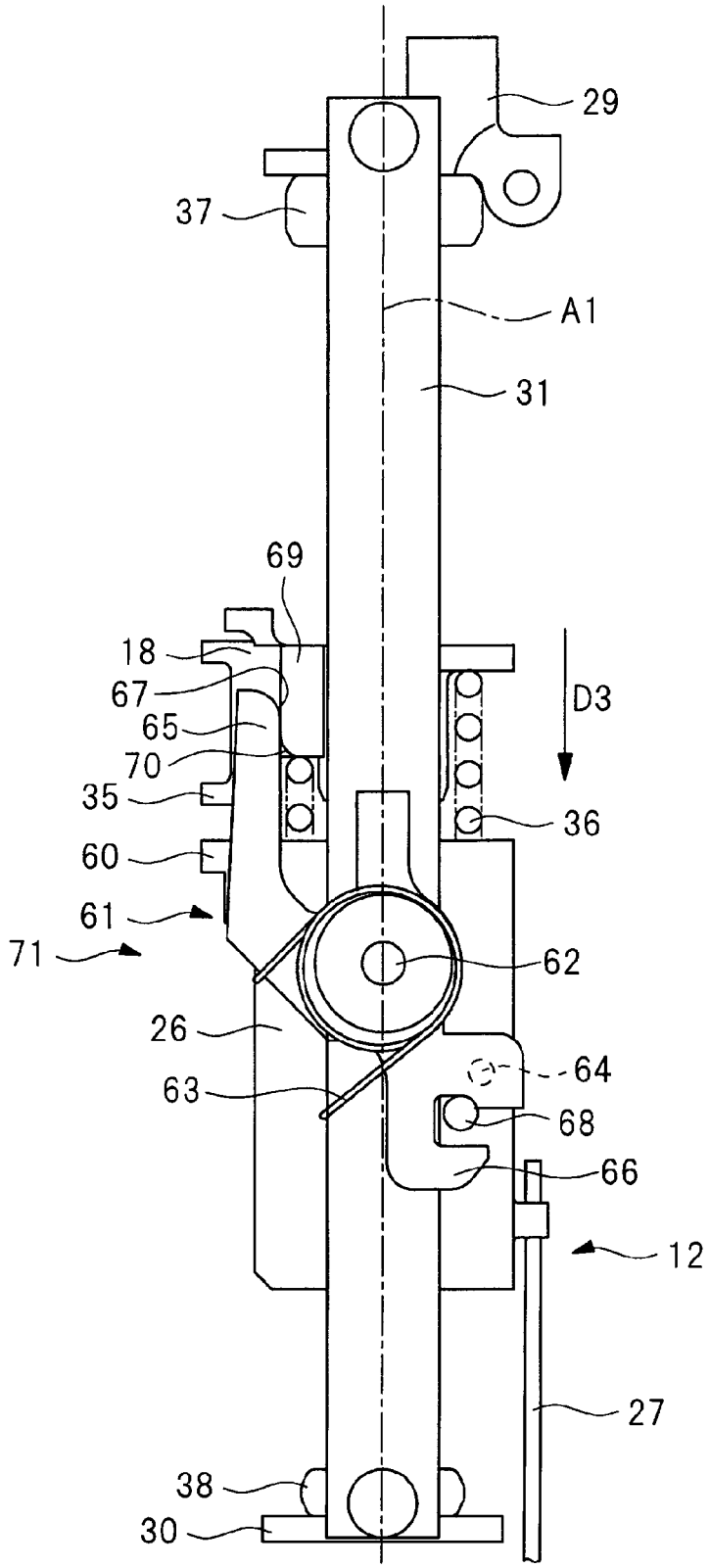
FIG. 18 is a side view of a state where the weight further descends from a location shown in FIG. 17 and the hitting part stops at the top dead center.

Next, as shown in FIG. 18, the plunger 26 reaches the top dead center and, simultaneously, the weight 18 further descends. Additionally, the contacting part 69 is maintained in a state of contacting with the arm 65. Further, the cam roller 58 shown in FIG. 4 is released from the second arm part 60 shown in FIG. 18. Consequently, the rotative force of the electric motor 14 shown in FIG. 1 leads to being not transmitted to the plunger 26 shown in FIG. 18. However, the contacting part 69 contacts with the arm 65, and the contacting part 69 stops the latch 61. That is, as shown in FIG. 19, the hook 66 is maintained in the state of being engaged with the pin 68, and the plunger 26 stops.

Figure 19:
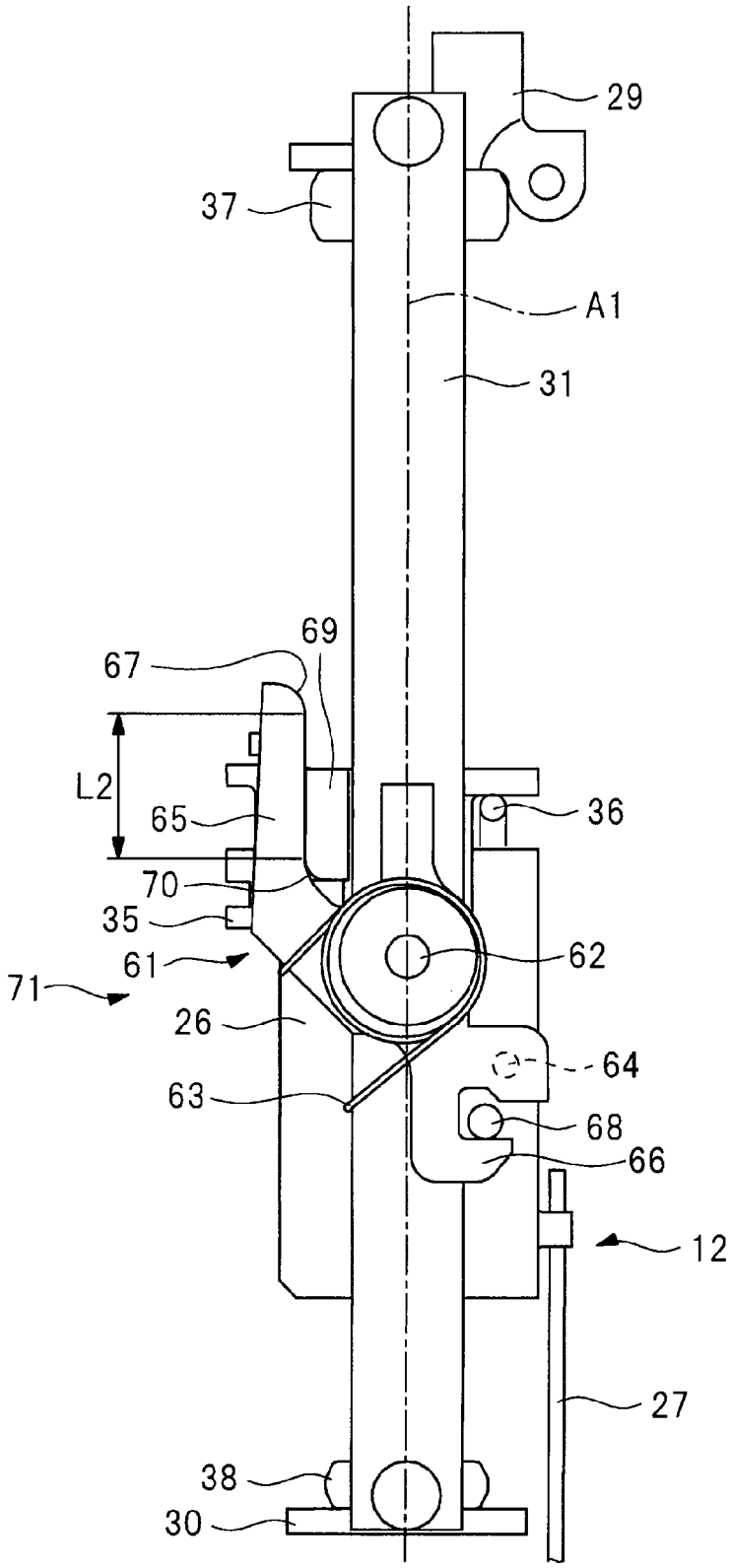
FIG. 19 is a side view of a state where the weight reaches the bottom dead center and the hitting part stops at the top dead center.

Then, after the weight 18 reaches the bottom dead center, the cam roller 59 shown in FIG. 4 is released from the weight arm part 35 shown in FIG. 19. Consequently, the rotative force of the electric motor 14 shown in FIG. 1 leads to being not transmitted to the weight 18 shown in FIG. 19, and the weight 18 ascends from the bottom dead center due to the energizing force of the spring 36. Even if the weight 18 starts ascending, the contacting part 69 stops the latch 61 since the contacting part 69 contacts with the arm 65. For this reason, the hook 66 is maintained in the state of being engaged with the pin 68, and the plunger 26 stops.

Figure 20:
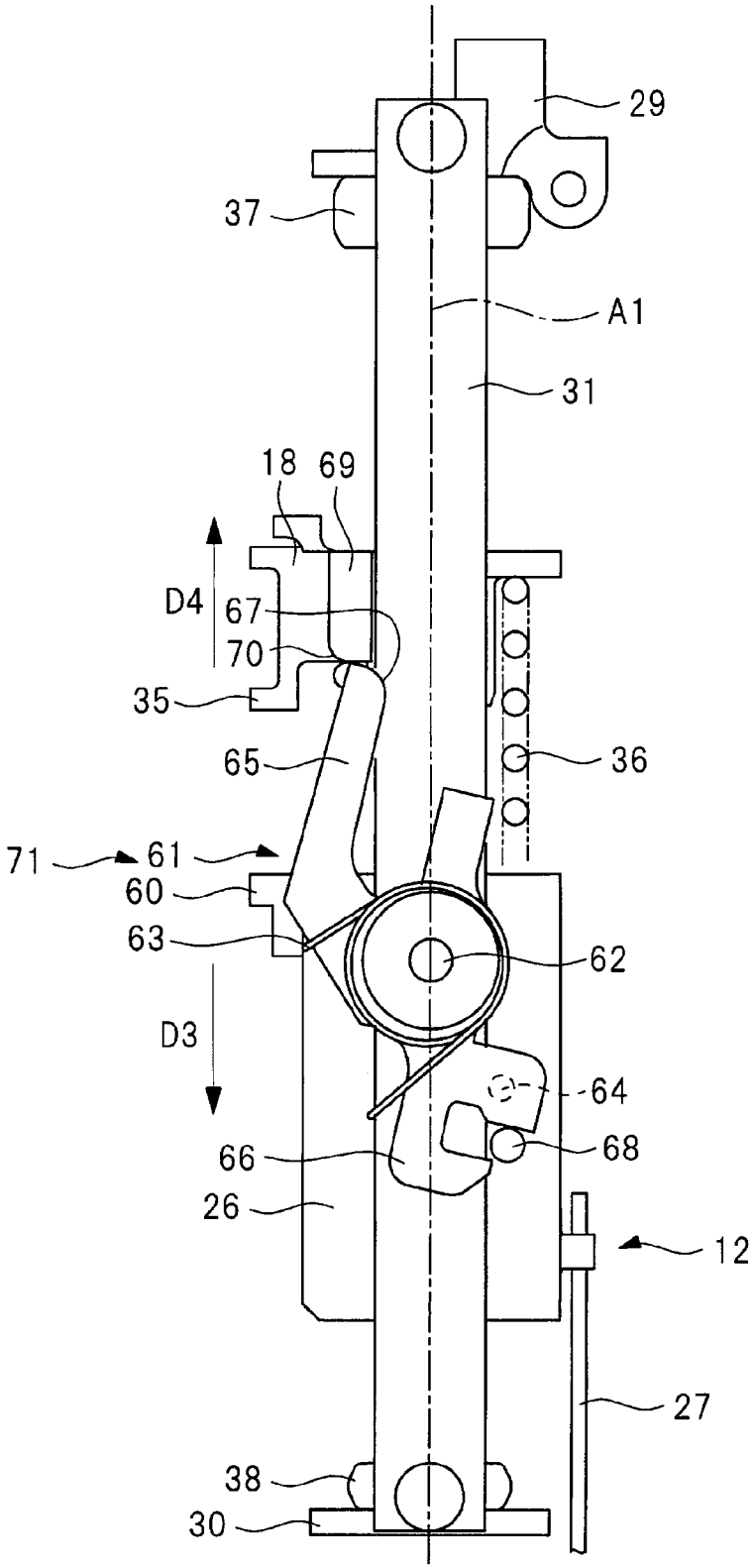
FIG. 20 is a side view of a state where the hitting part descends from the top dead center and the weight ascends from the bottom dead center.

When the weight further descends and the contacting part 69 is separated from the arm 65 as shown in FIG. 20, the latch 61 operates clockwise due to the energizing force of the spring 63. Consequently, the hook 66 is released from the pin 68, and the plunger 26 descends from the top dead center due to the energizing force of the spring 36.

When the plunger 26 descends, the driver blade 27 strikes the fastener 25 located on the ejecting path 24. After the driver blade 27 strikes the fastener 25, the plunger 26 collides with the plunger bumper 38 as shown in FIG. 14. Additionally, the weight 18 collides with the weight bumper 37. Also in the second embodiment of the driving machine 10, the recoil brought when the hitting part 12 strikes the fastener 25 is reducible.

Operative examples of the plunger 26 and the weight 18 in the second embodiment of the driving machine 10 will be described with reference to FIG. 13. The position of the plunger 26 in the second embodiment of the driving machine 10 is indicated by a broken line, and the position of the weight 18 is indicated by a solid line. The position of the plunger 26 in the second embodiment of the driving machine 10 corresponds to the position of the weight 18 in the first embodiment of the driving machine 10, and the position of the weight 18 in the second embodiment corresponds to the position of the plunger 26 in the first embodiment.

In the second embodiment of the driving machine 10, the latch 61 operates according to the position of the weight 18 in the direction of the axis A1, and the relationship between the first timing when the weight 18 starts ascending from the bottom dead center and the second timing when the plunger 26 starts descending from the top dead center is determined. Therefore, the second embodiment of the driving machine 10 can obtain the same effect as that of the first embodiment of the driving machine 10.

In the second embodiment of the driving machine 10, the timing when the weight 18 descends from the top dead center is changeable or adjustable by setting the number of cam rollers 59 and the positions of the cam rollers 59 in the rotational direction of the third gear 52. In the second embodiment of the driving machine 10, the timing when the weight 18 reaches the bottom dead center is changeable or adjustable by setting a diameter of a circumcircle of the cam roller 59 in the radial direction of the third gear 52. In the second embodiment of the driving machine 10, the timing when the plunger 26 ascends from the bottom dead center is changeable or adjustable by setting the number of cam rollers 57 and the positions of the cam rollers 57 in the rotational direction of the first gear 50.

In the second embodiment of the driving machine 10, the timing when the plunger 26 reaches the top dead center is changeable or adjustable by setting a diameter of a circumcircle of the cam roller 57 in the radial direction of the first gear 50.

As shown in FIG. 19, in the second embodiment of the driving machine 10, the timing when the plunger 26 descends from the top dead center is changeable or adjustable by setting an axis-A1-directional length of the arm 65 to L2. The timing when the plunger 26 descends from the top dead center is definable as a required time between the timing when the weight 18 ascends from the bottom dead center and the timing when the plunger 26 descends from the top dead center. The required time corresponds to an interval of time between the time t6 and the time t7 in the time chart of FIG. 13. A length L2 of the arm 65 is such a value that the contacting part 69 can prevent the latch 61 from operating when the arm 65 and the contacting part 69 contact with each other. For example, as the length L2 of the arm 65 is set relatively shorter, the required time becomes relatively shorter.

Third Embodiment

A third embodiment of a driving machine having a third regulating mechanism will be described with reference to FIGS. 1 and 21. A pressing member 72 is attached to the plunger 26. The pressing member 72 is, as one example, a metal pin. A spring 73 is attached to the plunger 26. The spring 73 is, as one example, a compression spring made of metal, and the spring 73 energizes the pressing member 72 in a direction intersecting with the axis A1. The pressing member 72 is energized by the spring 73 and stops at a position of contacting with the stopper.

Additionally, a tip part of the pressing member 72 has a sufficient coefficient of friction to convert the operating force of the pressing member 72 into the driving force of the gear 76, i.e., into a rotative force when contacting with the gear 76. A configuration in which the friction coefficient of the tip part of the pressing member 72 is set in this way includes selection of at least a part of a material of the pressing member 72 and selection of a shape of the tip part of the pressing member 72. One example of selecting the at least a part of the material of the pressing member 72 is that at least a part of the pressing member 72 is made of synthetic rubber. One example of selecting the shape of the tip part of the pressing member 72 includes a convex portion provided at the tip part of the pressing member 72, and a rack-shaped uneven (concave and convex) portion.

A movable member 74 and gears 75, 76 are provided in the housing 11 shown in FIG. 1. The movable member 74 is operable in an axis-C1 direction intersecting with the axis A1. The movable member 74 is, as one example, a metal pin. A guide member that supports the movable member 74 so as to be operable in a direction of an axis C1 is provided in the housing 11. The movable member 74 has a rack(s) 77 arranged along the direction of the axis C1. As one example, an outer diameter of the gear 76 is larger than an outer diameter of the gear 75, and the gear 75 and the gear 76 meshes with each other.

The gear 76 does not have teeth that are provided on a part of an outer peripheral surface that transmits a driving force by a frictional force when contacting with the pressing member 72. Further, a portion of the gear 76, which contacts with the tip part of the pressing member 72, can be also provided with a tooth (or teeth) that is (or are) engaged with the convex portion and/or uneven portion of the pressing member 72. The gear 75 meshes with the rack 77. The gear 75 is rotatable so as to be centered about a supporting shaft 79, and the gear 76 is rotatable so as to be centered about a supporting shaft 80.

A spring 78 is provided in the housing 11, and the spring 78 energizes the movable member 74 in a direction of approaching the weight 18 in the direction of the axis C1. The spring 78 is, as one example, a metal compression spring. Further, an engaging part 81 is provided on the weight 18. The engaging part 81 is, as one example, a concave portion provided on the outer surface of the weight 18. A tip of the movable member 74 is engageable with and disengageable (releaseable) from the engaging part 81. The movable member 74, gears 75, 76, and spring 78 constitute a third regulating mechanism 82.

Figure 21:
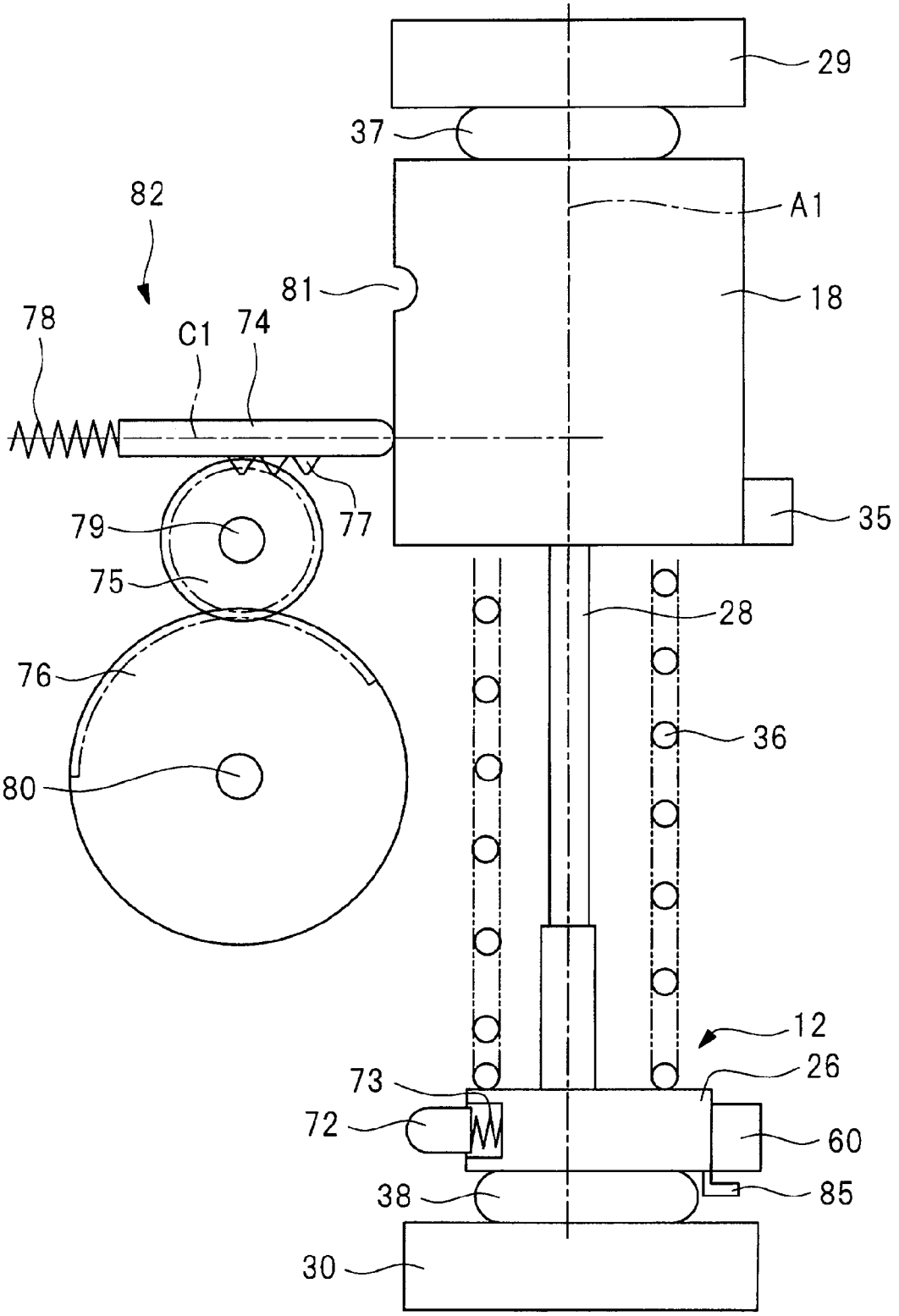
FIG. 21 is a side view of a state where a hitting part is located at a bottom dead center and a weight is located at a top dead center in a third embodiment of the driving machine.

The third regulating mechanism 82, weight 18, and plunger 26 shown in FIG. 21 can be provided in the driving machine 10 shown in FIG. 1, and the driving machine 10 is the third embodiment. The plunger 26 shown in FIG. 21 has a second arm part 60. The cam roller 57 shown in FIG. 4 is engageable with and disengageable from the first arm part 85 shown in FIG. 21, and the cam roller 58 is engageable with and disengageable from the second arm part 60. The weight 18 shown in FIG. 21 has a weight arm part 35. The cam roller 59 shown in FIG. 4 is engageable with and disengageable from the weight arm part 35 shown in FIG. 21.

A usage example of the third embodiment of the driving machine 10 will be described. When the electric motor 14 shown in FIG. 1 stops, the plunger 26 is energized by the spring 36 and stops at the bottom dead center as shown in FIG. 21. The pressing member 72 is separated from the gear 76. Additionally, the weight 18 is energized by the spring 36 and stops at the top dead center. Since the gears 75, 76 stop, the movable member 74 stops at a predetermined position in the direction of the axis C1. The movable member 74 is released from the engaging part 81.

Figure 22:
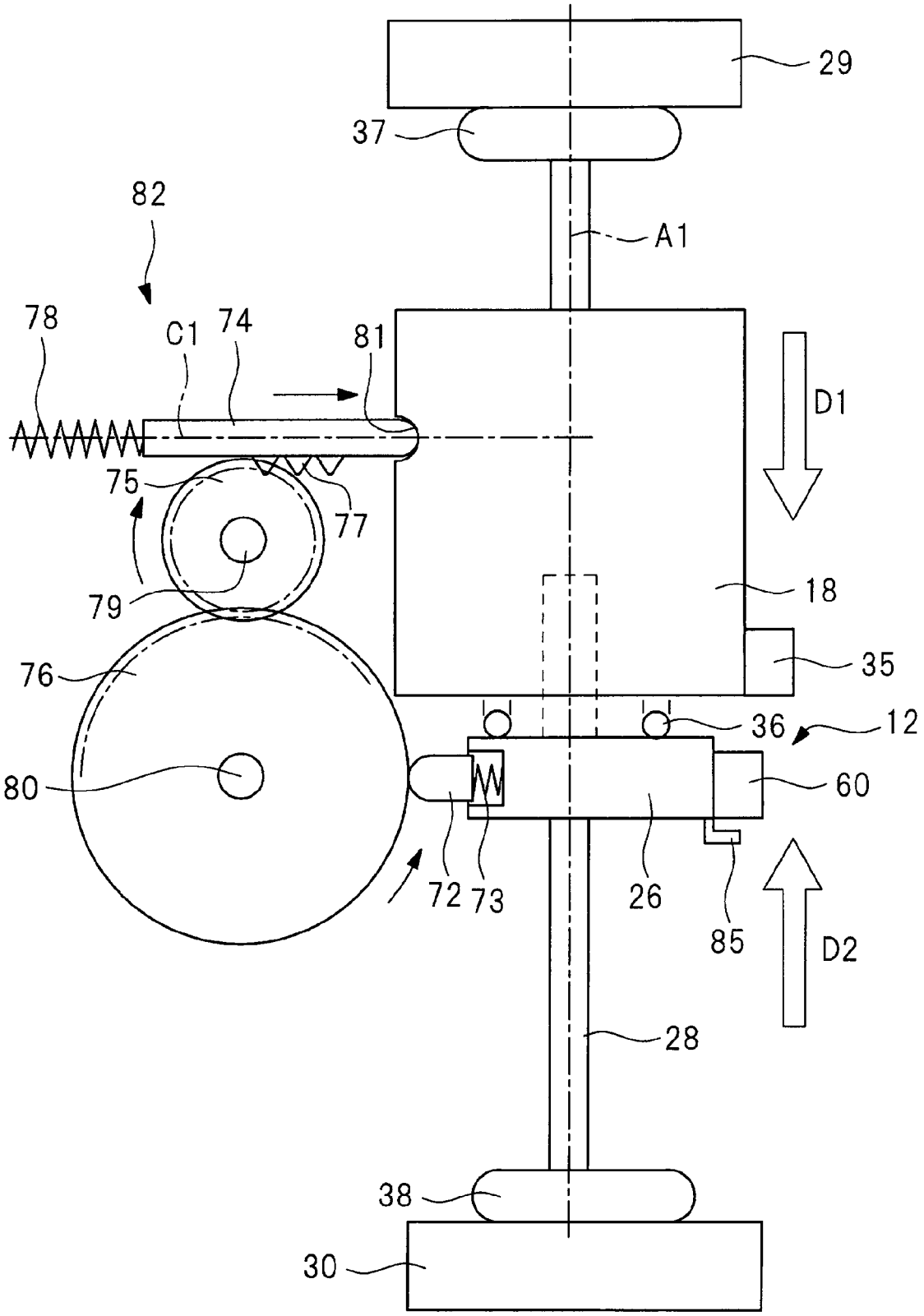
FIG. 22 is a side view of a state where the hitting part ascends from the bottom dead center shown in FIG. 21 and the weight descends from the top dead center shown in FIG. 21.

When the rotative force of the electric motor 14 shown in FIG. 1 is transmitted to the plunger 26 shown in FIG. 21, the plunger 26 ascends from the bottom dead center. Further, similarly to the first embodiment of the driving machine 10, when the rotative force of the electric motor 14 shown in FIG. 1 is transmitted to the weight 18 shown in FIG. 21, the weight 18 descends from the top dead center. Then, the tip of the pressing member 72 contacts with the outer surface of the gear 76 as shown in FIG. 22. Consequently, the gear 76 rotates a predetermined angle counterclockwise in FIG. 22 due to an ascending force of the plunger 26. Additionally, the gear 75 rotates a predetermined angle clockwise in FIG. 22, and the movable member 74 approaches the weight 18 in the direction of the axis C1. Then, when the plunger 26 reaches the top dead center and the weight 18 reaches the bottom dead center, the movable member 74 is engaged with the engaging part 81.

Further, when the cam roller 59 shown in FIG. 4 is released from the weight arm part 35, a function of holding (keeping) the weight 18 at the bottom dead center is released in the cam roller 59. However, the movable member 74 remains engaged with the engaging part 81, and the movable member 74 holds the weight 18 at the bottom dead center. Then, when the cam roller 58 shown in FIG. 4 is released from the second arm part 60, the plunger 26 descends from the top dead center as shown in FIG. 23.

Figure 23:
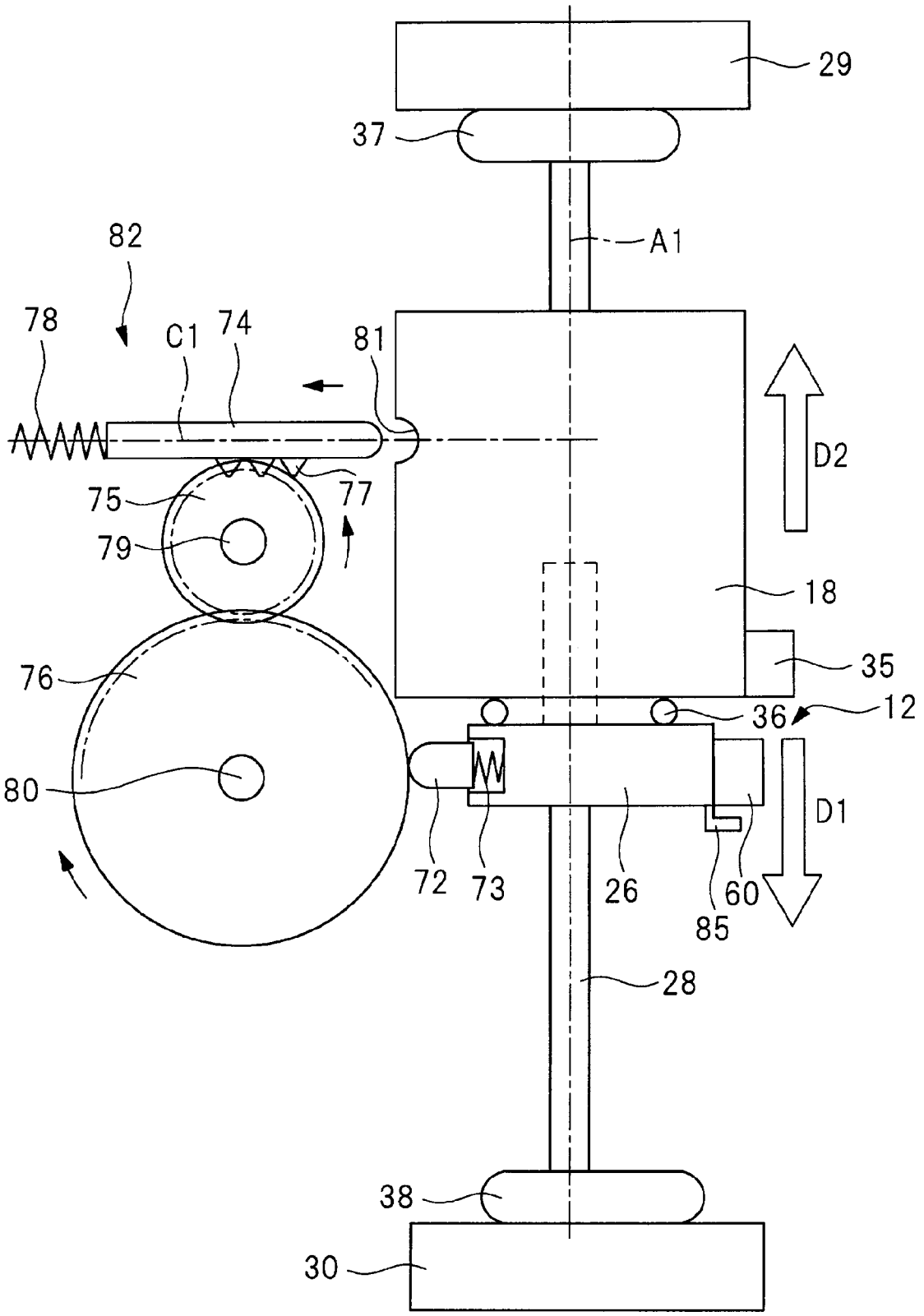
FIG. 23 is a side view of a state where the hitting part starts descending from the top dead center and the weight starts ascending from the bottom dead center.

Consequently, the gear 76 rotates a predetermined angle clockwise in FIG. 23 due to a descending force of the plunger 26. When the gear 76 rotates, the gear 75 rotates a predetermined angle counterclockwise in FIG. 23. Thus, the movable member 74 is separated from the weight 18 against the force of the spring 78. When the pressing member 72 is separated from the gear 76, the gears 76, 75 stop and the movable member 74 stops at a predetermined position.

Figure 24:
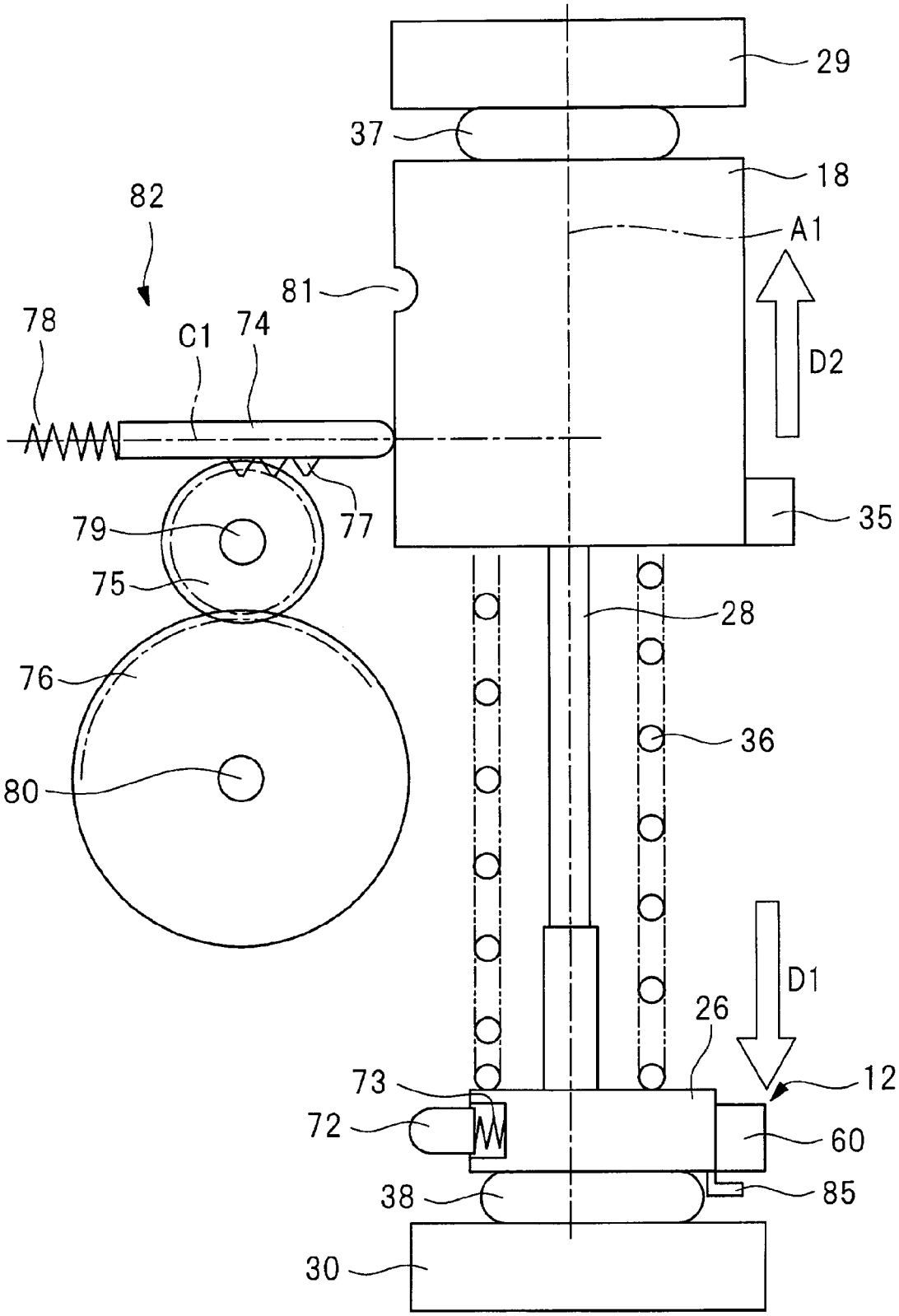
FIG. 24 is a side view of the state where the hitting part descends to reach the bottom dead center and the weight ascends to reach the top dead center.

When the movable member 74 is released (disengaged) from the engaging part 81, the weight 18 ascends from the bottom dead center due to the energizing force of the spring 36. Further, the plunger 26 reaches the bottom dead center and stops thereat as shown in FIG. 24, and the weight 18 reaches the top dead center and stops thereat.

In the third embodiment of the driving machine 10, the gears 75, 76 and the movable member 74 operate according to the position of the plunger 26 in the direction of the axis A1, and the relationship between the first timing when the plunger 26 starts descending from the top dead center and the second timing when the weight 18 starts ascending from the bottom dead center is determined. Therefore, the third embodiment of the driving machine 10 can obtain almost the same effect as that of the first embodiment of the driving machine 10.

In the third embodiment of the driving machine 10, the timing when the plunger 26 ascends from the bottom dead center is changeable or adjustable based on almost the same principle as that of the first embodiment of the driving machine 10. In the third embodiment of the driving machine 10, the timing when the plunger 26 reaches the top dead center is changeable or adjustable based on almost the same principle as that of the first embodiment of the driving machine 10. In the third embodiment of the driving machine 10, the timing when the plunger 26 descends from the top dead center is changeable or adjustable based on almost the same principle as that of the first embodiment of the driving machine 10.

In the third embodiment of the driving machine 10, the timing when the weight 18 descends from the top dead center is changeable or adjustable based on almost the same principle as that of the first embodiment of the driving machine 10. In the third embodiment of the driving machine 10, the timing when the weight 18 reaches the bottom dead center is changeable or adjustable based on almost the same principle as that of the first embodiment of the driving machine 10.

Further, in the third embodiment of the driving machine 10, the timing when the weight 18 ascends from the bottom dead center is changeable or adjustable based on: a rotational angle of the gear 76 with respect to an operating amount of plunger 26; a change gear ratio in transmitting motive power from the gear 76 to the gear 75; and an operating amount in separating the movable member 72 from the weight 18 with respect to a rotational angle of the gear 75. The timing when the weight 18 ascends from the bottom dead center is definable as a required time between the timing when the plunger 26 descends from the top dead center and the timing when the weight 18 ascends from the bottom dead center. Then, as the operating amount in separating the movable member 74 from the weight 18 becomes relatively larger, the movable member 74 is more easily released from the engaging part 81 and the function of holding the weight 18 at the bottom dead center is more easily released in the movable member 74.

For example, if it is assumed that the operating amount of the plunger 26 is the same, the required time becomes shorter as the rotational angle of the gear 76 relative to the operating amount of the plunger 26 is relatively larger. Additionally, if it is assumed that the rotational angle of the gear 75 relative to the operating amount of the plunger 26 is the same, the required time becomes shorter as the operating amount of the movable member 74 relative to a change amount of rotational angles of the gear 75 is relatively larger. Further, if it is assumed that the rotational angle of the gear 75 relative to the operating amount of the plunger 26 is the same, the required time becomes shorter as the change gear ratio between the gear 76 and the gear 75 is relatively smaller.

Next, examples of technical meanings of items described in some embodiments will be described.

Example of Technical Meaning in First Embodiment

The driving machine 10 is an example of a driving machine. The first direction D1 is an example of a first direction, and the second direction D2 is an example of a second direction. The hitting part 12 is an example of a first movable member, and the weight 18 is an example of a second movable member. The spring 36 is an example of an energizing mechanism. The second gear 51 and the cam roller 58 are an example of a first regulating mechanism, and the third gear 52 and the cam roller 59 are an example of a second regulating mechanism. The drive mechanism 83 is an example of a drive mechanism.

The third regulating mechanism 71 is an example of a third regulating mechanism. The supporting shaft 62 is an example of a supporting shaft, and the latch 61 is an example of a latch. The arm 65 is an example of a first end part, and the guide bar 31 and the guide shaft 28 are examples of supporting members. The hook 66 is an example of a second end part. As shown in FIG. 11, a state where the arm 65 contacts with the contacting part 32 and the hook 66 is engaged with the pin 34 is an example of a first state. As shown in FIG. 12, a state in which the arm 65 is separated from the contacting part 32 and the hook 66 is released from the pin 34 is an example of a second state.

Example of Technical Meaning in Second Embodiment

The weight 18 is an example of a first movable member. The hitting part 12 is an example of a second movable member and a hitting part. The first direction D4 is an example of a first direction, and the second direction D3 is an example of a second direction. The second gear 51 and the cam roller 58 are an example of a first regulating mechanism, and the first gear 50 and the cam roller 57 are an example of a second regulating mechanism.

As shown in FIG. 19, a state where the arm 65 contacts with the contacting part 69 and the hook 66 is engaged with the pin 68 is an example of a first state. As shown in FIG. 20, a state where the arm 65 is separated from the contacting part 69 and the hook 66 is released from the pin 68 is an example of a second state. Other technical meanings in the second embodiment are the same as those in the first embodiment.

Example of Technical Meaning in Third Embodiment

The plunger 26 having the pressing member 72 is an example of a first movable member. The third regulating mechanism 82 is an example of a third regulating mechanism, and the gears 75, 76 are examples of rotational elements. The movable member 74 is an example of a regulating shaft, and the spring 78 is an example of an elastic member. As shown in FIG. 22, a state where the pressing member 72 contacts with the gear 76 and the movable member 74 is engaged with the engaging part 81 is an example of a first state of the third regulating mechanism. As shown in FIG. 23, a state where the pressing member 72 is separated from the gear 76 and the movable member 74 is separated from the weight 18 is an example of a second state of a third regulating mechanism. Other technical meanings in the third embodiment are the same as those in the first embodiment.

The driving machine is not limited to the above-described embodiments, but can be variously modified within a range of not departing from the gist thereof. For example, described in the first to third embodiments of the driving machine 10 has been an example in which the controller 40 controls a stopping position of the electric motor 14 so that the hitting part 12 stops at the bottom dead center and the weight 18 stops at the top dead center when the trigger switch 43 is turned off. In contrast, the controller may control a stopping position of the electric motor 14 so that the hitting part 12 stops between the bottom dead center and the top dead center and the weight 18 stops between the top dead center and the bottom dead center when the trigger switch 43 is turned off.

Additionally, a used state of the driving machine 10 may be either a first used state where the axis A1 is parallel to a vertical line or a second used state where the axis A1 intersects with a vertical line. The second used state may be either a state where a cross angle between the axis A1 and the vertical line is 90 degrees or a state where a cross angle between the axis A1 and the vertical line has an angle other than 90 degrees.

Further, the used state of the driving machine 10 may be any of: a third used state where the hitting part 12 is located below the weight 18 in the direction of the axis A1; a fourth used state where the hitting part 12 is located above the weight 18 in the direction of the axis A1; and a fifth used state where the hitting part 12 is located at the same height as that of the weight 18 in the direction of the axis A1.

In the third or fifth used state of the driving machine 10, "the hitting part 12 or weight 18 operates in the first direction D1" is definable as "forward". Additionally, "the hitting part 12 or weight 18 operates in the second direction D2" is definable as "backward".

In the third or fifth used state of the driving machine 10, "the hitting part 12 or weight 18 operates in the second direction D3" is definable as "forward". Additionally, "the hitting part 12 or weight 18 operates in the first direction D4" is definable as "backward".

In the fourth used state of the driving machine 10, "the hitting part 12 or weight 18 operates in the first direction D1" is definable as "ascent". Additionally, "the hitting part 12 or weight 18 operates in the second direction D2" is definable as "descent".

In the fourth used state of the driving machine 10, "the hitting part 12 or weight 18 operates in the second direction D3" is definable as "ascent". Additionally, "the hitting part 12 or weight 18 operates in the first direction D4" is definable as "descent".

The energizing mechanism for energizing the first movable member in the first direction and energizing the second movable member in the second direction includes a non-ferrous metal spring, a synthetic rubber, a gas spring, and a magnetic spring besides a metal spring. The metal spring or non-ferrous metal spring may be either a compression spring or a tension spring. Further, a spring in which metal and non-ferrous metal are compounded (combined) or used together may be used. Additionally, the energizing mechanism for energizing the first movable member in the first direction and the energizing mechanism for energizing the second movable member in the second direction may be configured by physically identical members or by physically separate members. That is, each energizing mechanism may be, regardless of the generation principle of the energizing force, a mechanism for operating the first movable member at such a speed as to be capable of hitting (striking) the fastener and for operating the second movable member in an opposite direction to the first movable member.

The first regulating mechanism contacts with the first movable member directly or indirectly, thereby preventing the first movable member from operating in the first direction. The principle of causing the first regulating mechanism to prevent the first movable member from operating may be either an engaging force or a frictional force. "The first movable member prevents the first movable member from operating" includes "stopping the first movable member" and "restricting the operation of the first movable member".

The second regulating mechanism contacts with the second movable member directly or indirectly, thereby preventing the second movable member from operating in the second direction. The principle of causing the second regulating mechanism to prevent the second movable member from operating may be either an engaging force or a frictional force. "The second regulating mechanism prevents the second movable member from operating" includes "stopping the second movable member" and "regulating the operation of the second movable member". "Allowing the first movable member or second movable member to operate" means "the first movable member or second movable member is operable due to the energizing force of the energizing mechanism". Each operation of the first movable member, second movable member, regulating shaft, rotational element, and latch is definable as movement of each of the first movable member, second movable member, regulating shaft, rotational element, and latch.

The third regulating mechanism is not limited to a regulation releasing means described in at least one embodiment so long as directly or indirectly affecting the first movable member and third movable member to operate the first drive member and second drive member in conjunction with each other. For example, the third regulating mechanism may also include not only a first configuration but also a second configuration: the first configuration of switching the state of the third regulating mechanism by operating the first movable member that has been exemplified by the above-mentioned embodiment; and the second configuration in which the first regulating mechanism and third regulating mechanism are directly or indirectly engaged with each other, the first regulating mechanism allows the operation of the first movable member, and the first regulating mechanism switches the state of the third regulating mechanism.

The drive mechanism includes a motor as a power source, and a power transmission mechanism for transmitting the rotative force of the motor. The power transmission mechanism includes a pulley, a gear, a roller, a sprocket, a belt, and a chain. Additionally, at least a part of elements of the power transmission mechanism and at least a part of elements of a first operative mechanism may be common. Further, at least a part of elements of the power transmission mechanism and at least a part of elements of the second operative mechanism may be common. Furthermore, the motor includes an electric motor, a hydraulic motor, a pneumatic motor, and an engine. A power supply of the electric motor may be either a DC power supply or an AC power supply.

Instead of the plunger and the driver blade, a piston and a driver blade may be used as the hitting part. Rotational elements of the third regulating mechanism include a gear and a roller. An elastic member of the third regulating mechanism may be any of a metal spring, a non-ferrous metal spring, and a synthetic rubber. The metal spring or non-ferrous metal spring may be either a compression spring or a tension spring. Each of the third regulating mechanisms shown in the first and second embodiments may be provided on at least one of the two guide bars 31.

EXPLANATION OF SYMBOLS

10 . . . Driving machine; 12 . . . Hitting part; 18 . . . Weight; 28 . . . Guide shaft; 31 . . . Guide bar; 36, 78 . . . Spring; 50 . . . First gear; 51 . . . Second gear; 52 . . . Third gear; 57, 58, 59 . . . Cam roller; 61 . . . Latch; 62 . . . Supporting shaft; 65 . . . Arm; 66 . . . Hook; 71, 82 . . . Third regulating mechanism; 74 . . . Movable member (Regulating shaft); 75, 76 . . . Gear; 83 . . . Drive mechanism; D1, D4 . . . First direction; and D2, D3 . . . Second direction.

The invention claimed is:

1. A driving machine comprising:

a first movable member operable to move in a first direction and a second direction opposite to the first direction;

a second movable member operable to move in the first direction and the second direction;

an energizing mechanism that energizes the first movable member in the first direction and energizes the second movable member in the second direction;

a first regulating mechanism that has states of preventing and allowing the movement of the first movable member in the first direction;

a second regulating mechanism that has states of preventing and allowing the movement of the second movable member in the second direction; and a third regulating mechanism that has a first contacting part that is brought into contact with the first movable member and a second contacting part that is brought into contact with the second movable member, the third regulating mechanism having a first state of preventing the second movable member from moving in the second direction while the second contacting part being in contact with the second movable member and a second state of allowing the second movable member to move in the second direction, wherein the third regulating mechanism is different from the first regulating mechanism and the second regulating mechanism, and wherein the third regulating mechanism switches from the first state to the second state in response to a state of the first movable member.

2. The driving machine according to claim 1, wherein the first movable member directly affects the third regulating mechanism without intervention of the first regulating mechanism and the second regulating mechanism to switch the third regulating mechanism from the first state to the second state when the first movable member is allowed to move in the first direction.

3. The driving mechanism according to claim 1, further comprising a drive mechanism provided to move the first movable member in the second direction and move the second movable member in the first direction, wherein the first regulating mechanism has states of preventing and allowing the movement of the first movable member in the first direction after the first movable member moves in the second direction, and wherein the second regulating mechanism has states of preventing and allowing the movement of the second movable member in the second direction after the second movable member moves in the first direction.

4. The driving machine according to claim 1, wherein the first movable member and the second movable member approach each other when the first movable member moves in the second direction and the second movable member moves in the first direction, and wherein the first movable member and the second movable member are separated from each other when the first movable member moves in the first direction and the second movable member moves in the second direction.

5. The driving machine according to claim 1, wherein the third regulating mechanism includes a latch operable so as to be centered about a supporting shaft, wherein the latch has the first contacting part and the second contacting part, wherein the supporting shaft is disposed between the first contacting part and the second contacting part in a longitudinal direction of the latch.

6. The driving machine according to claim 1, wherein the first contacting part of the third regulating mechanism includes a rotational element that is brought into contact with the first movable member to convert a moving force of the first movable member into a rotative force;

wherein the second contacting part of the third regulating mechanism includes a regulating shaft that operates with a rotative force of the rotational element; and wherein the third regulating mechanism further includes an elastic member that energizes the regulating shaft in a direction of approaching the second movable member, wherein the first state of the third regulating mechanism regulates the movement of the second movable member in the second direction by bringing the regulating shaft into contact with the second movable member, and wherein the second state of the third regulating mechanism allows the second movable member to move in the second direction by separating the regulating shaft from the second movable member.

7. The driving machine according to claim 1, further comprising a supporting member provided so as to support the first movable member operably in the first direction and the second direction and support the second movable member operably in the second direction and the first direction, wherein the energizing mechanism is disposed between the first movable member and the second movable member in the first direction and the second direction.

8. The driving machine according to claim 1, wherein the first movable member includes a hitting part operable to move in the first direction to strike a fastener, and wherein the second movable member includes a weight that suppresses a recoil brought when the hitting part strikes the fastener.

9. The driving machine according to claim 1, wherein the second movable member includes a hitting part operable to move in the second direction to strike a fastener, and wherein the first movable member includes a weight that suppresses a recoil brought when the hitting part strikes the fastener.

10. A driving machine comprising:

a first movable member operable to move in a first direction and a second direction opposite to the first direction;

a second movable member operable to move in the first direction and the second direction;

an energizing mechanism that energizes the first movable member in the first direction and energizes the second movable member in the second direction;

a first regulating mechanism that has states of preventing and allowing the movement of the first movable member in first direction;

a second regulating mechanism that has states of preventing and allowing the movement of the second movable member in the second direction; and a third regulating mechanism that has a first contacting part that is brought into contact with the first movable member and a second contacting part that is brought into contact with the second movable member, the third regulating mechanism having a first state of preventing the second movable member from moving in the second direction while the second contacting part being in contact with the second movable member and a second state of allowing the second movable member to move in the second direction, wherein the third regulating mechanism is different from the first regulating mechanism and the second regulating mechanism, and wherein the third regulating mechanism is held at the first state while the first movable member is prevented from moving in the first direction, and wherein the third regulating mechanism switches from the first state to the second state by allowing the first movable member to operate in the first direction.

11. A driving machine comprising:

a first movable member operable to move in a first direction and a second direction opposite to the first direction;

a second movable member operable to move in the first direction and the second direction;

an energizing mechanism that energizes the first movable member in the first direction and energizes the second movable member in the second direction;

a first regulating mechanism that has states of preventing and allowing the movement of the first movable member in first direction;

a second regulating mechanism that has states of preventing and allowing the movement of the second movable member in the second direction; and a third regulating mechanism that has a contacting part, the third regulating mechanism having a first state of preventing the second movable member from moving in the second direction while the contacting part being in contact with the second movable member, and a second state of allowing the second movable member to move in the second direction, wherein the third regulating mechanism is different from the first regulating mechanism and the second regulating mechanism, and wherein a predetermined period of time after the first movable member moves in the first direction, the third regulating mechanism switches from the first state to the second state and allows to move the second movable member in the second direction.

* * * * *